US008186524B2

(12) United States Patent
Siahpush

(10) Patent No.: US 8,186,524 B2
(45) Date of Patent: May 29, 2012

(54) TRAY FOR CARRYING FOOD AND CONTAINED BEVERAGES

(76) Inventor: S. Anthony Siahpush, Omaha, NE (US)

( * ) Notice: Subject to any disclaimer, the term of this patent is extended or adjusted under 35 U.S.C. 154(b) by 337 days.

(21) Appl. No.: 12/661,061

(22) Filed: Mar. 10, 2010

(65) Prior Publication Data

US 2011/0220599 A1 Sep. 15, 2011

(51) Int. Cl.
*A47B 47/00* (2006.01)

(52) U.S. Cl. ..... 211/196; 211/133.4

(58) Field of Classification Search ..... 211/196, 211/205, 166, 107, 133.4, 68, 62, 70, 129.1, 211/131.1, 144, 163, 126.2, 74; 248/158; 108/94, 95, 139; 206/557, 558, 562
See application file for complete search history.

(56) References Cited

U.S. PATENT DOCUMENTS

| | | | | | |
|---|---|---|---|---|---|
| 152,550 | A | | 6/1874 | Collins | |
| 652,257 | A | * | 6/1900 | Folger | 211/39 |
| 663,838 | A | * | 12/1900 | White | 211/70 |
| 796,234 | A | | 8/1905 | Merriman | |
| 953,007 | A | | 3/1910 | Haller | |
| 978,670 | A | * | 12/1910 | Solomon | 211/163 |
| 1,445,029 | A | * | 2/1923 | Orrill | 211/65 |
| 1,761,088 | A | * | 6/1930 | Pryde | 211/68 |
| 1,888,141 | A | | 11/1932 | Orth | |
| 3,168,229 | A | | 2/1965 | Heifetz | |
| 3,464,648 | A | * | 9/1969 | Fuhriman | 242/139 |
| 3,826,378 | A | * | 7/1974 | Novak | 211/70.5 |
| 4,757,956 | A | * | 7/1988 | McGuire | 242/139 |
| 4,838,596 | A | | 6/1989 | Stanfield | |
| 4,923,236 | A | | 5/1990 | Bunck | |
| 4,991,726 | A | * | 2/1991 | Johnson | 211/189 |
| 5,570,793 | A | * | 11/1996 | Killough | 211/70 |
| 5,772,050 | A | * | 6/1998 | Shih | 211/39 |
| 6,681,684 | B1 | * | 1/2004 | Chen | 99/448 |
| 7,144,610 | B1 | * | 12/2006 | Estes et al. | 428/19 |
| 7,458,475 | B2 | * | 12/2008 | Ho | 211/85.23 |
| 7,520,550 | B2 | | 4/2009 | Lord | |
| 2003/0015486 | A1 | * | 1/2003 | Chen | 211/70 |
| 2009/0195005 | A1 | | 8/2009 | Lord | |

* cited by examiner

*Primary Examiner* — Jennifer E. Novosad
(74) *Attorney, Agent, or Firm* — Dennis L. Thomte; Thomte Patent Law Office LLC

(57) ABSTRACT

A tray is disclosed for carrying food on dinnerware between a restaurant kitchen to customers. The tray includes a vertically disposed support member having upper and lower ends with a handle being secured to the upper end of the support member. A plurality of vertically spaced and horizontally disposed disc-shaped members are selectively rotatably secured to the support member. Different sizes and shapes of dinnerware may be carried by the tray by inserting the inner ends thereof between the outer ends of the support members. The tray is also designed to be able to carry wine bottles and wine glasses.

14 Claims, 25 Drawing Sheets

TRAY FOR CARRYING FOOD AND CONTAINED BEVERAGES

BACKGROUND OF THE INVENTION

1. Field of the Invention

This invention relates to a tray for use by a waiter/waitress to carry food and/or contained beverages from a restaurant kitchen to the table of a customer(s).

2. Description of the Related Art

For many years, waiters/waitresses (hereinafter "waiter") in restaurants have delivered food from the kitchen to customers seated at a table in one of three ways. First, the waiter carries a plate or the like in each hand and delivers the same to the customers at their table. This method often requires two or more trips from the kitchen to the customers' table. A second method often employed by waiters is to place the plates, saucers, bowls, etc. on a tray and carry the tray to the customers' table. This method requires that a small table or stand be positioned near the customers' table upon which the loaded tray may be placed. A third method is for the waiter to place several plates or the like on his/her hand and arm. This method often results in the waiter dropping one or more of the plates often on a customer.

Prior art attempted solutions to the problems described above are discussed hereinbelow.

A plate rack is disclosed in U.S. Pat. No. 152,550 which issued on Jun. 30, 1874. The plate rack of the '550 Patent does permit the carrying of a plurality of stacked plates. However, it appears that the plate rack of the '550 Patent will only accommodate plates having identical diameters.

A waiter's tray is disclosed in U.S. Pat. No. 796,234 which issued on Aug. 1, 1905. The tray of the '234 Patent has limited space for receiving plates, bowls or dishes thereon. Further, the dinnerware must be positioned within the peripheral lips of the shelves 13 and 17.

A serving rack is disclosed in U.S. Pat. No. 953,007 which issued on Mar. 22, 1910. The ring-shaped shelves or trays of the '007 Patent appear to be designed so as to only support dishes having a certain diameter.

A plate rack is illustrated in U.S. Pat. No. 1,888,141 which issued on Nov. 15, 1932. Although the plate rack of the '141 Patent may be used to carry a plurality of plates, the shelves or rings 11 appear to be designed to support plates having a certain diameter.

A food receptacle carrier is disclosed in U.S. Pat. No. 4,923,236 which issued on May 8, 1990. Although the carrier of the '236 Patent is designed to carry a plurality of food receptacles thereon, the carrier may only accommodate those receptacles having diameters such that they may be received on the disks 10 and 12 and removed therefrom by way of the closures 27 and 28.

A plate carrier is the subject of U.S. Pat. No. 7,520,550 which issued on Apr. 21, 2009. It is believed that the plate carrier of the '550 carrier is difficult to use since the plates 28 are all positioned at one side of the spine 16 which will create a balance problem. Further, it is believed that the plate carrier of the '550 Patent will only carry plates having a particular shape and diameter.

US Published Application No. 2009/0195005 was published on Aug. 6, 2009 and is a continuation-in-part of U.S. Pat. No. 7,520,550. Although the '005 application illustrates a plate holder which will hold a variety of plates, the upper jaw of the plate holder must be manually adjusted with respect to the stationary lower jaw to accommodate different plates.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In the preferred embodiment, the tray for carrying food and contained beverages of this invention comprises an upstanding support member having upper and lower ends. A first horizontally disposed and generally disc-shaped member is secured at its center to the lower end of the upstanding support member. The first disc-shaped member has a peripheral edge, an upper side and a lower side. The first disc-shaped member has a plurality of radially spaced apart pairs of horizontally spaced-apart projections which extend upwardly from the upper side thereof inwardly of the peripheral edge thereof. A second horizontally disposed and generally disc-shaped second member is secured at its center to the upstanding support member above the first disc-shaped member. The second disc-shaped member includes a peripheral edge, an upper side and a lower side. The second disc-shaped member has a diameter which is less than the diameter of the first disc-shaped member. The second disc-shaped member has a plurality of radially spaced-apart cut-outs or recesses formed therein which define lobes therebetween having an arcuate outer end. Each of the lobes of the second disc-shaped member have a plurality of horizontally spaced-apart projections extending downwardly from the lower side thereof at the outer end thereof. A third horizontally disposed and generally disc-shaped member is secured at its center to the upstanding support member above the second disc-shaped member. The third disc-shaped member includes a peripheral edge, an upper side and a lower side. The third disc-shaped member has a diameter which is greater than the diameter of the second disc-shaped member and which is less than the diameter of the first disc-shaped member. The third disc-shaped member has a plurality of radially spaced-apart cut-outs or recesses formed therein which define lobes therebetween having an arcuate outer end. Each of the lobes of the third disc-shaped member have a plurality of horizontally spaced-apart projections extending upwardly from the upper side thereof at the outer end thereof. A fourth horizontally disposed and generally disc-shaped member is secured at its center to the upstanding support member above the third disc-shaped member. The fourth disc-shaped member has a peripheral edge, an upper side and a lower side. The fourth disc-shaped member has a diameter which is less than the diameter of the third disc-shaped member. The fourth disc-shaped member has a plurality of radially spaced-apart cut-outs or recesses formed therein which define lobes therebetween having an arcuate outer end. Each of the lobes of the fourth disc-shaped member have a plurality of horizontally spaced-apart projections extending downwardly from the lower side thereof at the outer end thereof.

A fifth horizontally disposed and generally disc-shaped member is secured at its center to the upstanding support member above the fourth disc-shaped member. The fifth disc-shaped member is substantially identical to the third disc-shaped member. A sixth horizontally disposed and generally disc-shaped member is secured at its center to the upstanding support member above the fifth disc-shaped member with the sixth disc-shaped member being substantially identical to the fourth disc-shaped member and to the second disc-shaped member. A seventh horizontally disposed and generally disc-shaped member is secured at its center to the upstanding support member above the sixth disc-shaped member with the seventh disc-shaped member being substantially identical to the sixth disc-shaped member.

In the preferred embodiment, a carrying handle is secured to the upper end of the upstanding support member and includes a horizontally disposed portion which is centered over the upper end of the upstanding support member.

In the preferred embodiment, the first disc-shaped member has at least one opening extending into its peripheral edge between the pairs of projections for receiving the stem of an upside-down wine glass therein. In the preferred embodiment, the third disc-shaped member has at least one opening extending into each of the lobes thereof for receiving the stem of an upside-down wine glass therein. In the preferred embodiment, the upper side of the first disc-shaped member has an inclined semi-circular recess formed therein forwardly of each of the pairs of projections thereof for partially receiving the bottom of an inclined wine bottle thereon to support the same. In the preferred embodiment, the second, third, fourth, fifth, sixth and seventh disc-shaped members are selectively rotatably mounted on the upstanding support member.

Although it is preferred that the tray includes first, second, third, fourth, fifth, sixth and seventh disc-shaped members, the tray may have less than those disc-shaped members.

Not only is the tray of this invention ideally suited for carrying food and contained beverages but the tray may also be used as a display stand or support to enable a business to display several different types of dinnerware.

It is therefore a principal object of the invention to provide an improved tray for carrying food and contained beverages.

A further object of the invention is to provide a tray of the type described which permits food service providers at restaurants to carry multiple varying sizes and shapes of dinner, appetizer and dessert plates and bowls thereon.

A further object of the invention is to provide a tray of the type described which permits food service providers at restaurants to carry various sizes and shapes of dinnerware and beverage containers to serve guests efficiently.

A further object of the invention is to provide a tray of the type described which enables food service providers in restaurants to deliver/carry food and beverage containers from the kitchen to the guests in an efficient and safe manner.

A further object of the invention is to provide a tray of the type described which is designed to accommodate the existing structure of various sizes and shapes of dinnerware to be carried.

A further object of the invention is to provide a tray of the type described which is designed to carry food and contained beverages by the provider at close to floor level to minimize accidental spills on guests while seated.

Yet another object of the invention is to provide a tray of the type described which enables food service providers to easily carry multiple sizes and shapes of dinnerware at a close distance to floor level to minimize potential spill over the guests while seated.

A further object of the invention is to provide a tray of the type described which is designed to be carried at the side of the food service provider so that the food service provider has a clear view of his/her travel path while serving the guest or guests.

Yet another object of the invention is to provide a tray of the type described which is designed to minimize the food service provider's contact with potentially hot dinnerware.

Still another object of the invention is to provide a tray of the type described which is designed to allow food service providers to carry various sizes and shapes of dinnerware and beverage containers so as to be served in limited spaces in restaurants.

Yet another object of the invention is to provide a tray of the type described which enables a more efficient handling and control of carrying dinnerware and contained beverage items to guests in restaurants.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
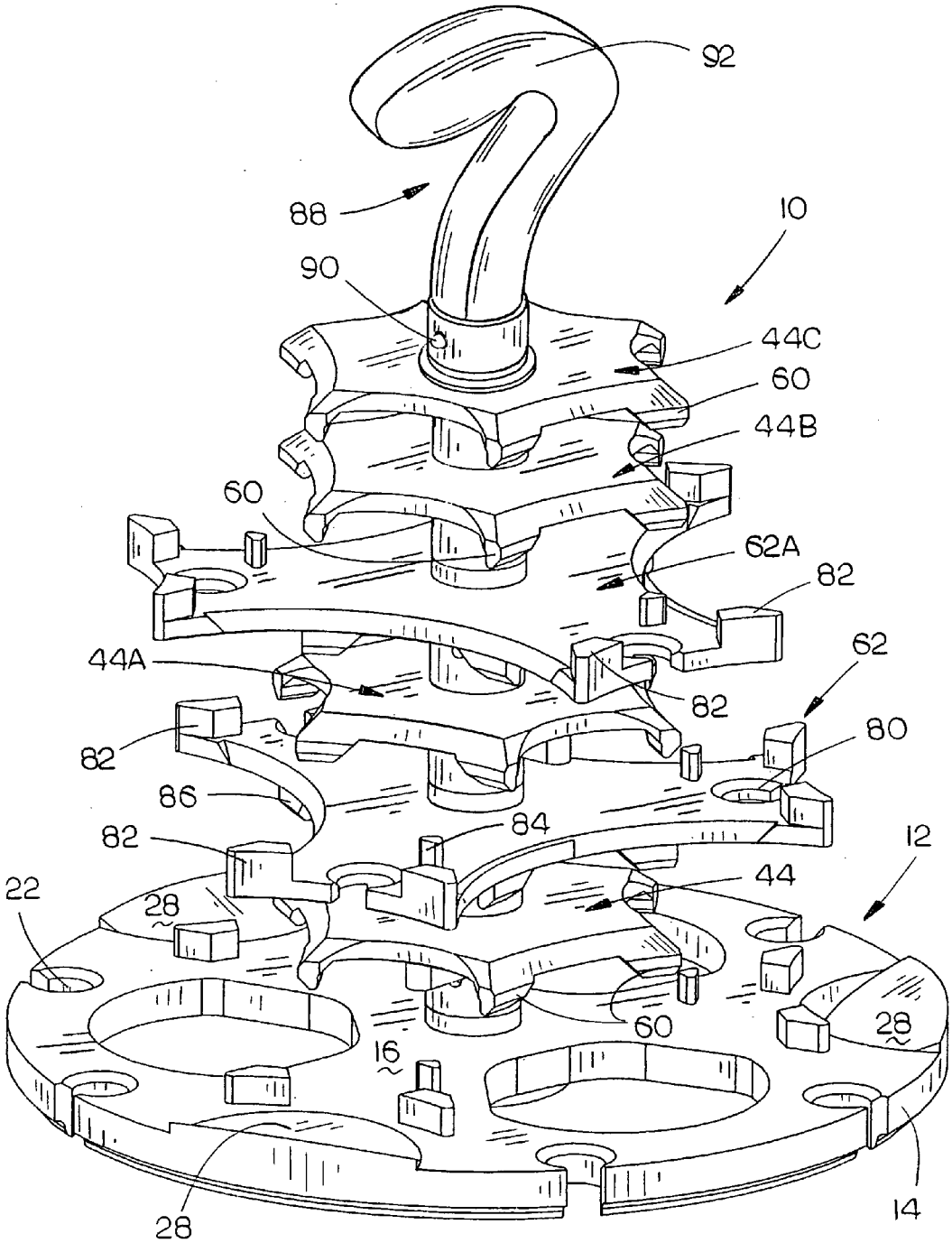
FIG. 1 is a perspective view of the preferred embodiment of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The preferred embodiment of the tray of this invention is illustrated in FIGS. 1-26 and is designated by the reference numeral 10. Tray 10 includes a first or bottom, generally disc-shaped member 12 having a peripheral edge 14, an upper side 16, and a lower side 18. Lower side 18 of member 12 has an annular rim 20 extending downwardly therefrom. Member 12 preferably includes a plurality of openings 22 extending thereinto from edge 14 for receiving the stems 24 of wine glasses 26 or the like. The upper side 16 of member 12 has a plurality of radially spaced-apart inclined surfaces 28 provided thereon adapted to receive the bottoms of wine bottles 30 thereon as will be described in more detail hereinafter.

The upper side 16 of member 12 has a pair of radially spaced-apart and upwardly extending projections 32 and 34 positioned inwardly of each of the surfaces 28. An upwardly extending stop 36 is provided on the upper side 16 of member 12 inwardly of each of the projections 32 and 34. Member 12 has a central opening 38 formed therein adapted to receive the lower end of an upstanding support member 40 which has a plurality of vertically spaced-apart, spring-loaded detent balls 42 partially extending therefrom.

Figure 5:
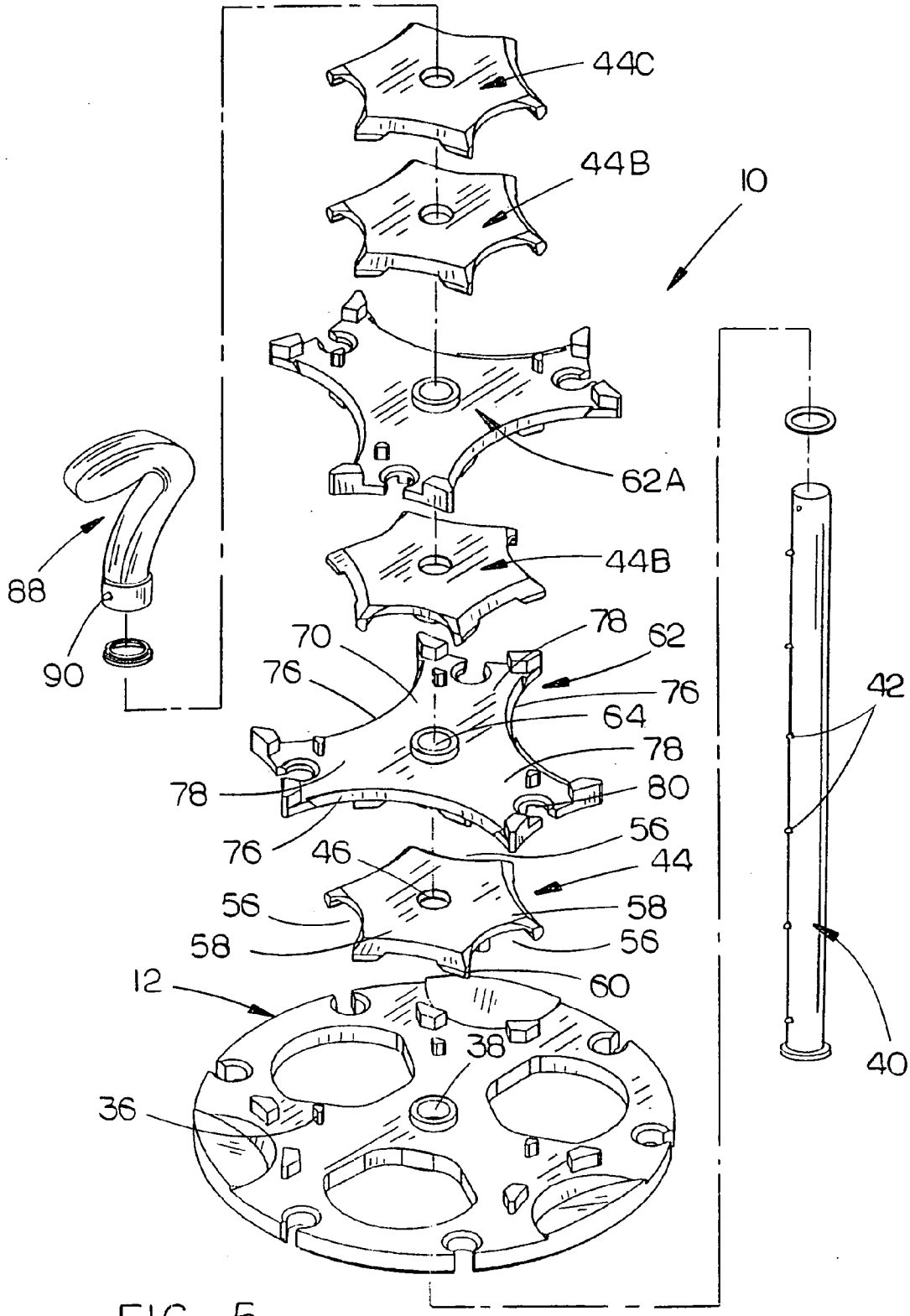
FIG. 5 is an exploded perspective view of the tray of FIG. 1.
Figure 6:
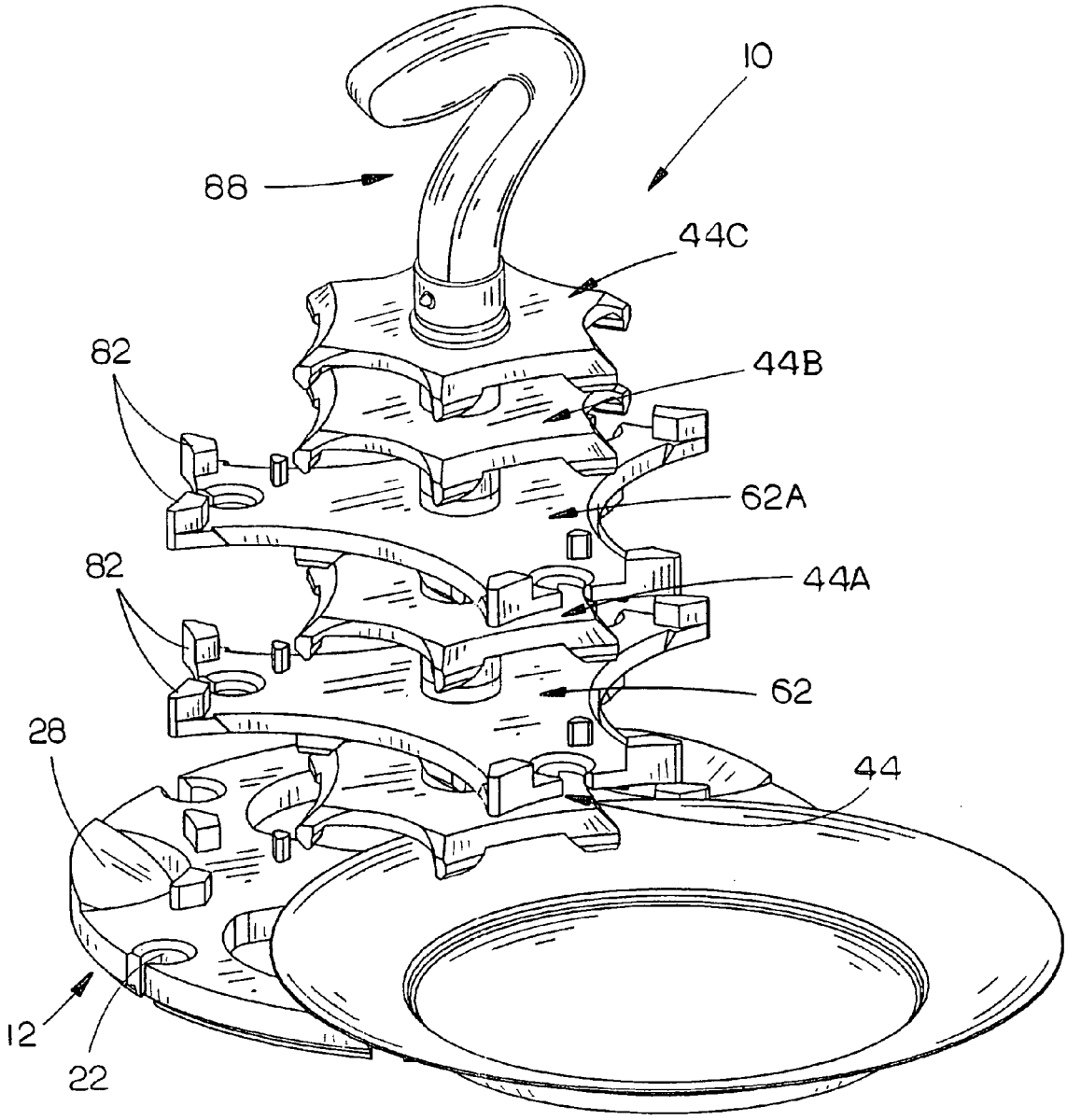
FIG. 6 is a perspective view of the tray of FIG. 1 illustrating a plate being carried thereby.
Figure 6A:
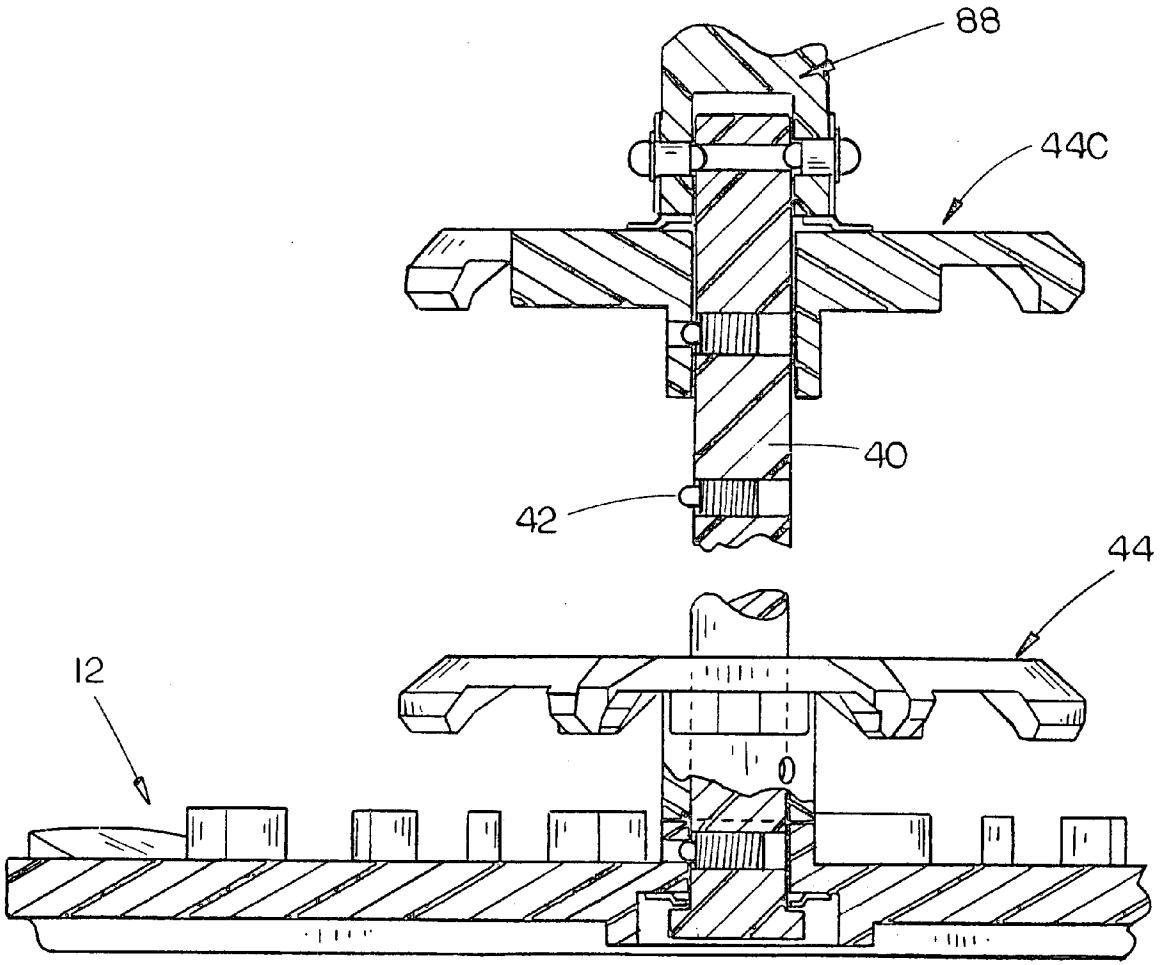
FIG. 6A is a partial sectional view illustrating a portion of the tray of FIG. 1.
Figure 7:
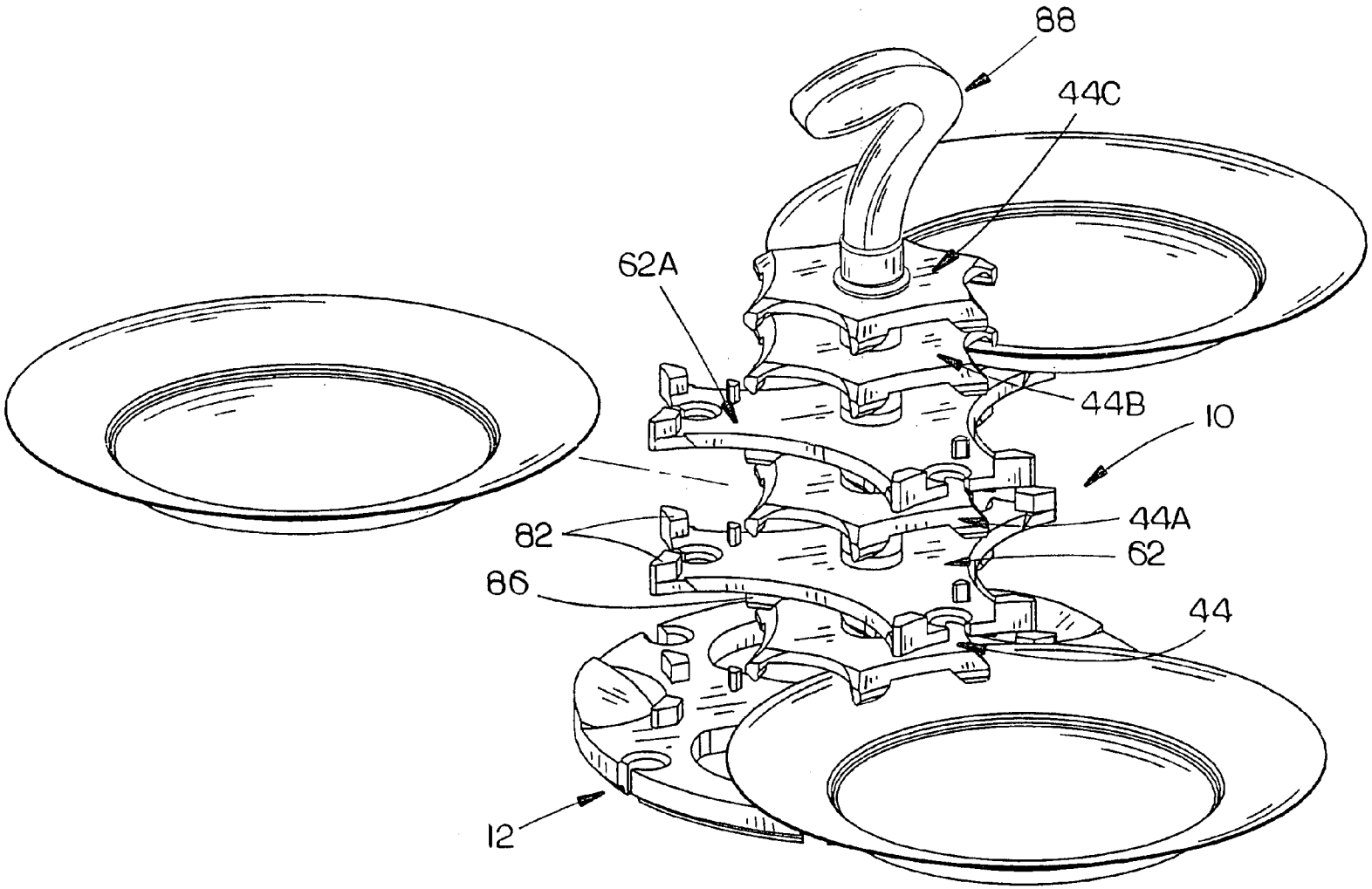
FIG. 7 is a perspective view illustrating a plurality of plates secured to the tray of FIG. 1 and a plate about to be secured to the tray of FIG. 1.
Figure 16:
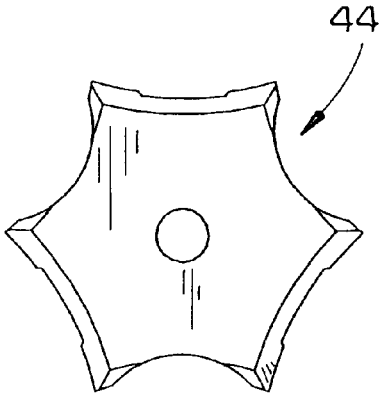
FIG. 16 is top view of the first disc-shaped member of FIG. 13.

The numeral 44 refers to a second, generally disc-shaped, member having a central opening 46 formed therein which communicates with a downwardly extending hub or pipe stub 47 which selectively rotatably embraces support 40 above member 12. Hub 47 includes a plurality of radially spaced-apart openings 48 formed therein each of which are adapted to receive a detent ball 42 therein to releasably rotatably position member 44 in various positions, preferably three, with respect to support member 40 and member 12. Member 44 includes an upper side 50, a lower side 52 and a peripheral edge 54. A plurality of generally semi-circular cut-outs or recesses 56 extend into the peripheral edge 54 of member 44 to define lobes 58 therebetween. Radially spaced-apart projections 60 extend downwardly from member 44 at the ends of the cut-outs 56 or lobes 58 as seen in FIGS. 5 and 16.

Figure 15:
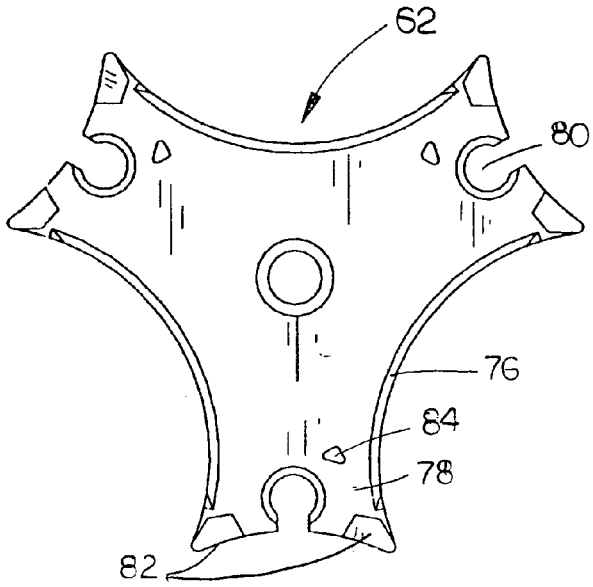
FIG. 15 is a top view of the third disc-shaped member of FIG. 12.
Figure 14:
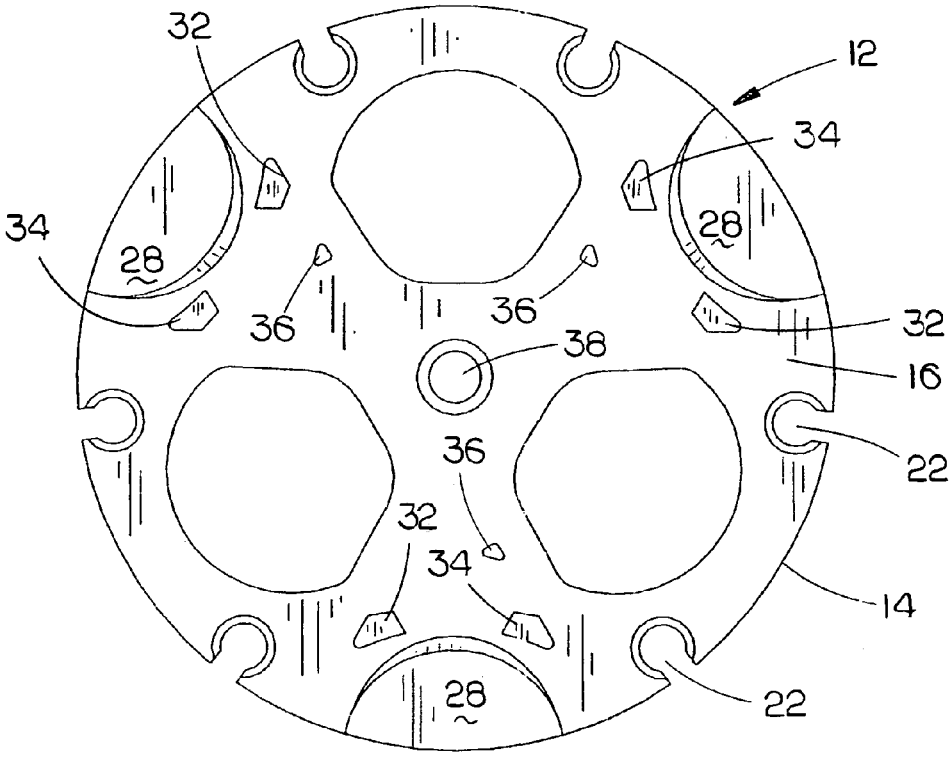
FIG. 14 is a top view of the first disc-shaped member of FIG. 11.
Figure 18:
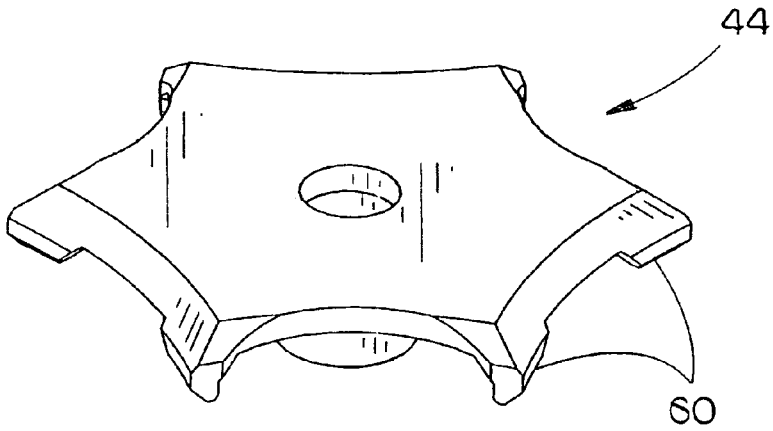
FIG. 18 is a top perspective view of the disc-shaped member of FIG. 13.
Figure 17:
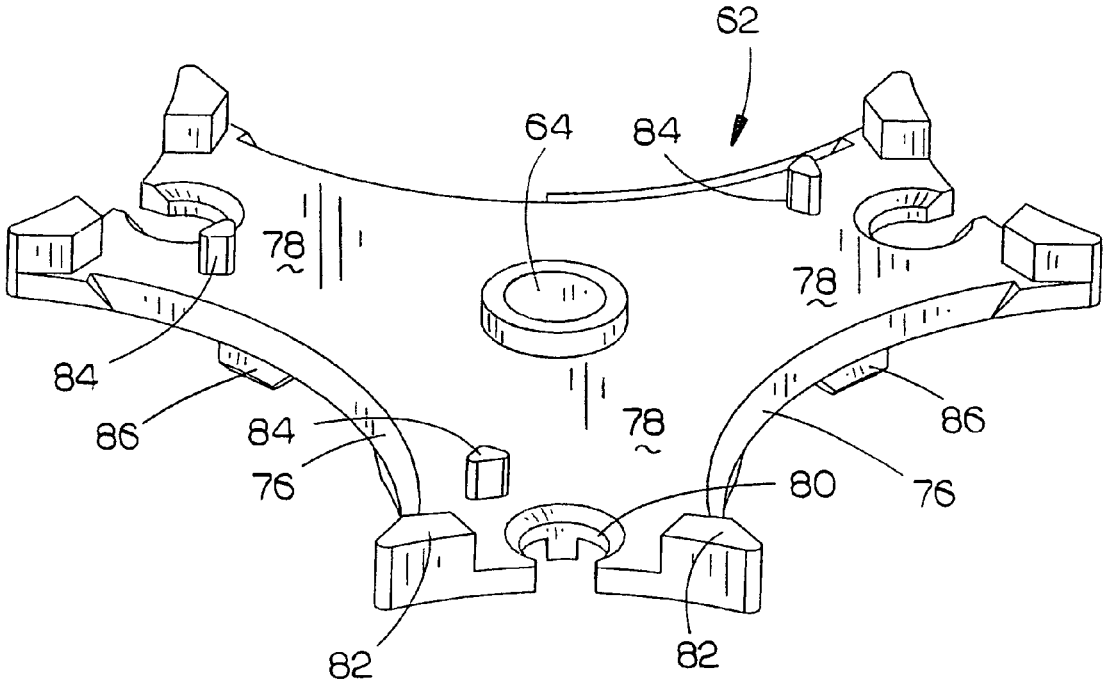
FIG. 17 is a top perspective view of the disc-shaped member of FIG. 12.
Figure 20:
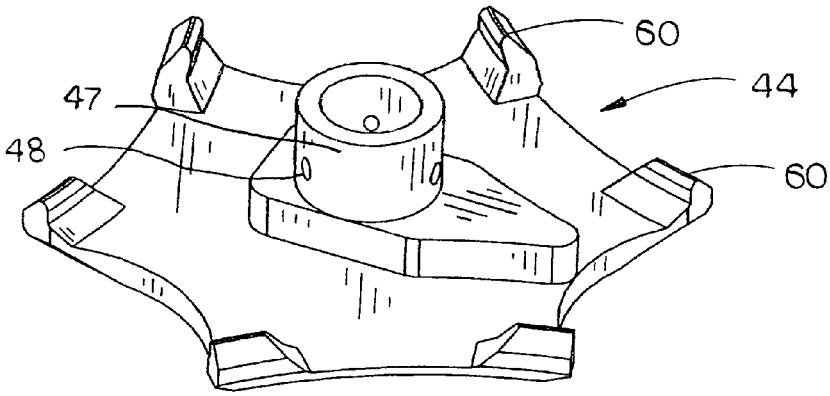
FIG. 20 is a bottom perspective view of the disc-shaped member of FIG. 18.
Figure 19:
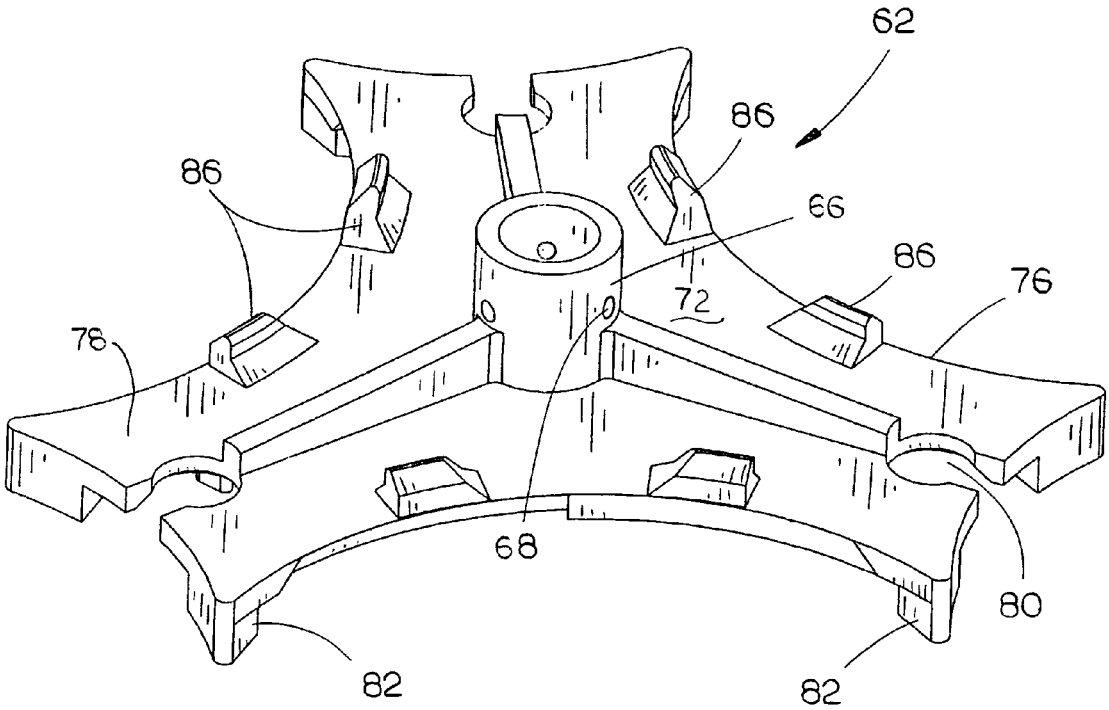
FIG. 19 is a bottom perspective view of the disc-shaped member of FIG. 17.
Figure 21:
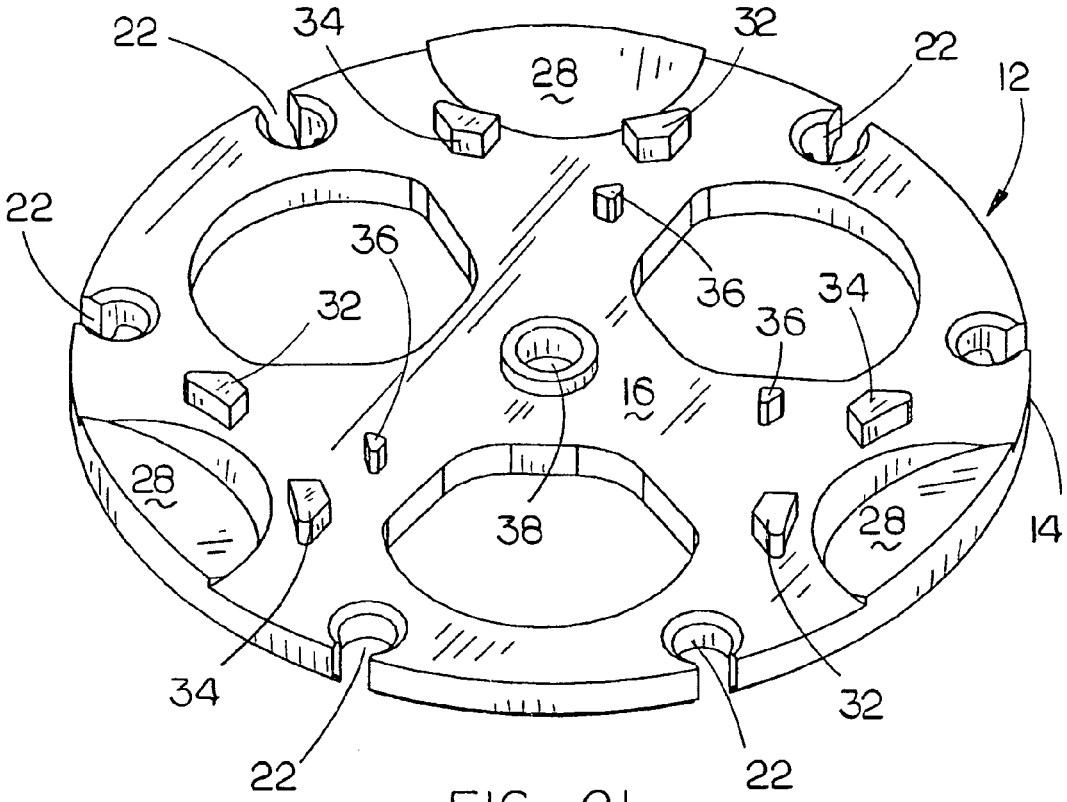
FIG. 21 is top perspective view of the first disc-shaped member of this invention.
Figure 22:
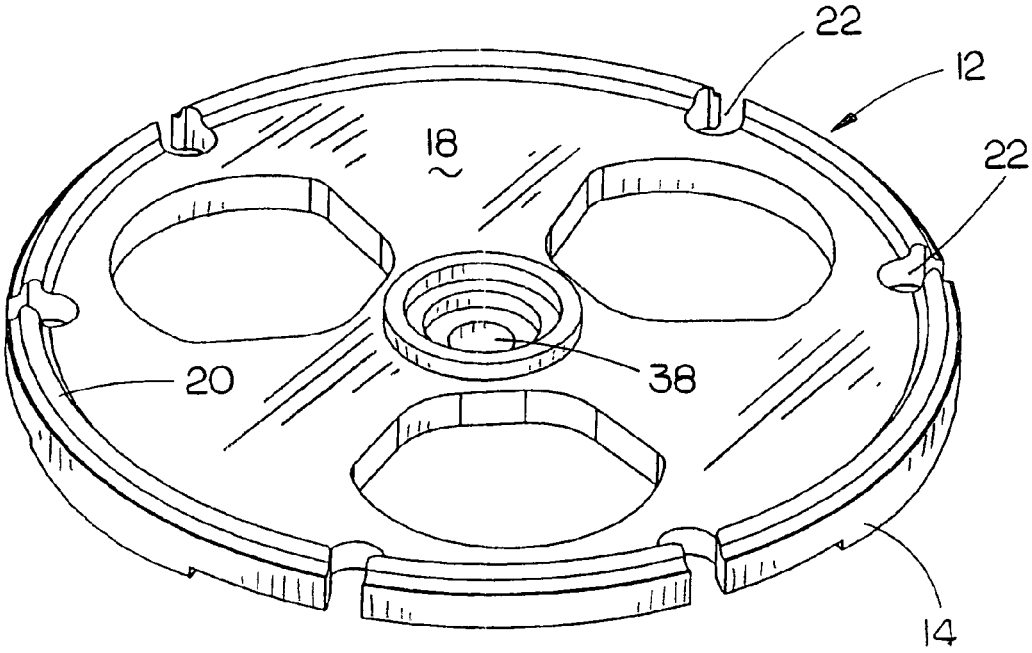
FIG. 22 is a bottom perspective view of the first disc-shaped member of FIG. 21.

The numeral 62 refers to a generally disc-shaped third member having a central opening 64 formed therein which communicates with a downwardly extending hub or pipe stub 66 which selectively rotatably embraces support member 40 above member 44. Hub 66 includes a plurality of radially spaced-apart openings 68 formed therein adapted to receive a detent ball 42 therein to selectively rotatably position member 62 in various positions, preferably three, with respect to support member 40. Member 62 includes an upper side 70, lower side 72 and a peripheral edge 74. Member 62 has a plurality of generally semi-circular cut-outs or recesses 76 extending into its peripheral edge 74 to define lobes 78 therebetween as seen in FIG. 15. Each of the lobes 78 has an opening 80 extending thereinto which is adapted to receive the stem 24 of a wine glass 26 therein. Each of the outer ends of the lobes 78 are arcuate and have upwardly extending projections 82 at the ends thereof. An upwardly extending stop 84 is provided on each of the lobes 78 inwardly of the outer ends thereof. The lower side 72 of member 62 is provided with downwardly extending projections 82 below the inner end of the cut-outs 76.

The numeral 44A refers to generally a fourth disc-shaped member which is identical to member 44 and which is selectively rotatably mounted on support member 40 above member 62. The numeral 62A refers to a generally disc-shaped fifth member which is identical to member 62 and which is selectively rotatably mounted on support member 40 above member 44A. A sixth generally disc-shaped member 44B, which is identical to member 44, is selectively rotatably mounted on support member 40 above member 62A. A generally disc-shaped seventh member 44C, which is identical to member 44, is selectively rotatably mounted on support member 40 above member 44B.

A handle 88 is selectively secured to the upper end of support member 40 by a detent mechanism 90 and has a horizontally extending upper end portion 92 which is centered over the support member 40.

Figure 27:
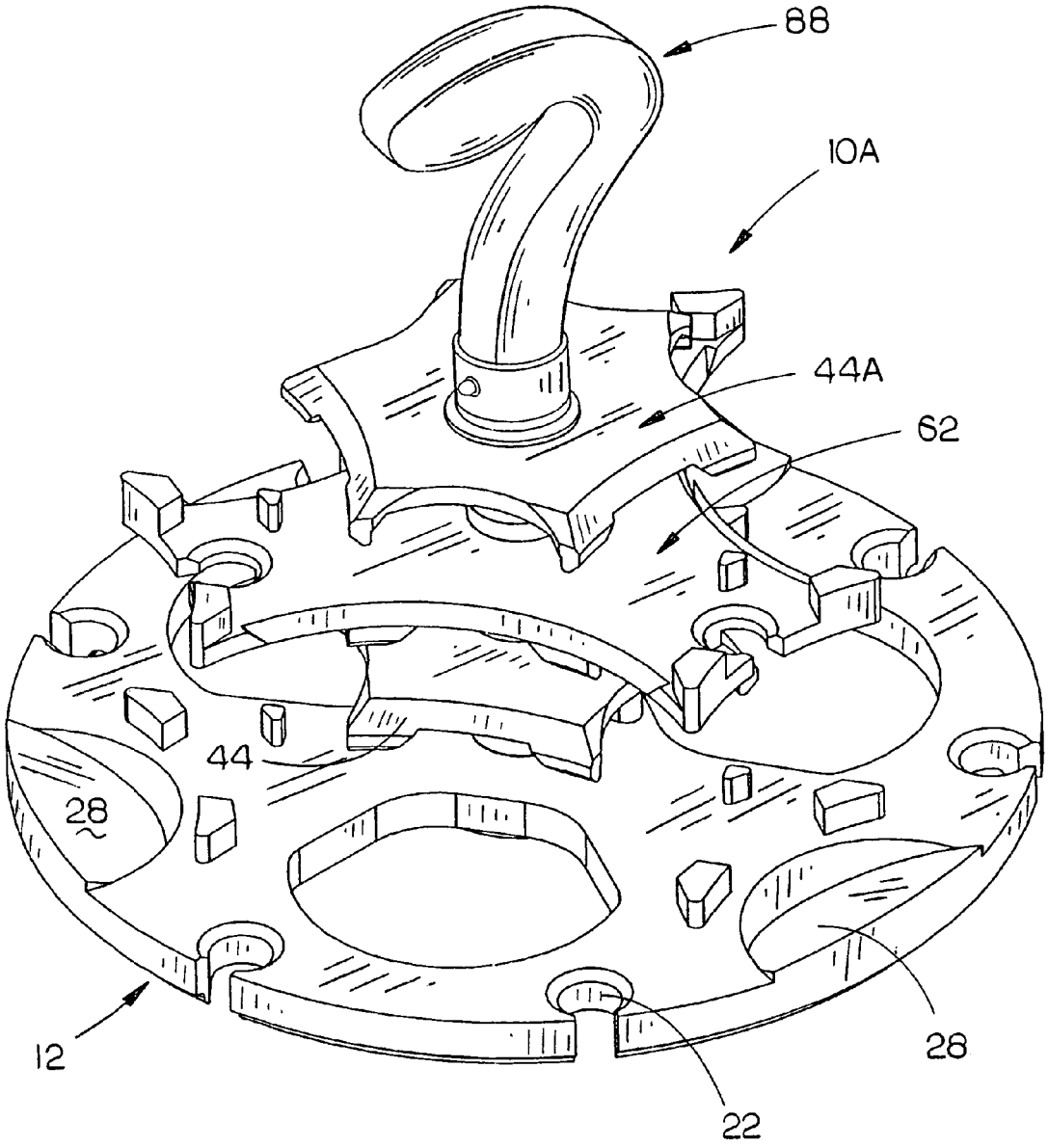
FIG. 27 is a perspective view of an embodiment of the invention which includes first, second, third and fourth disc-shaped members.
Figure 28:
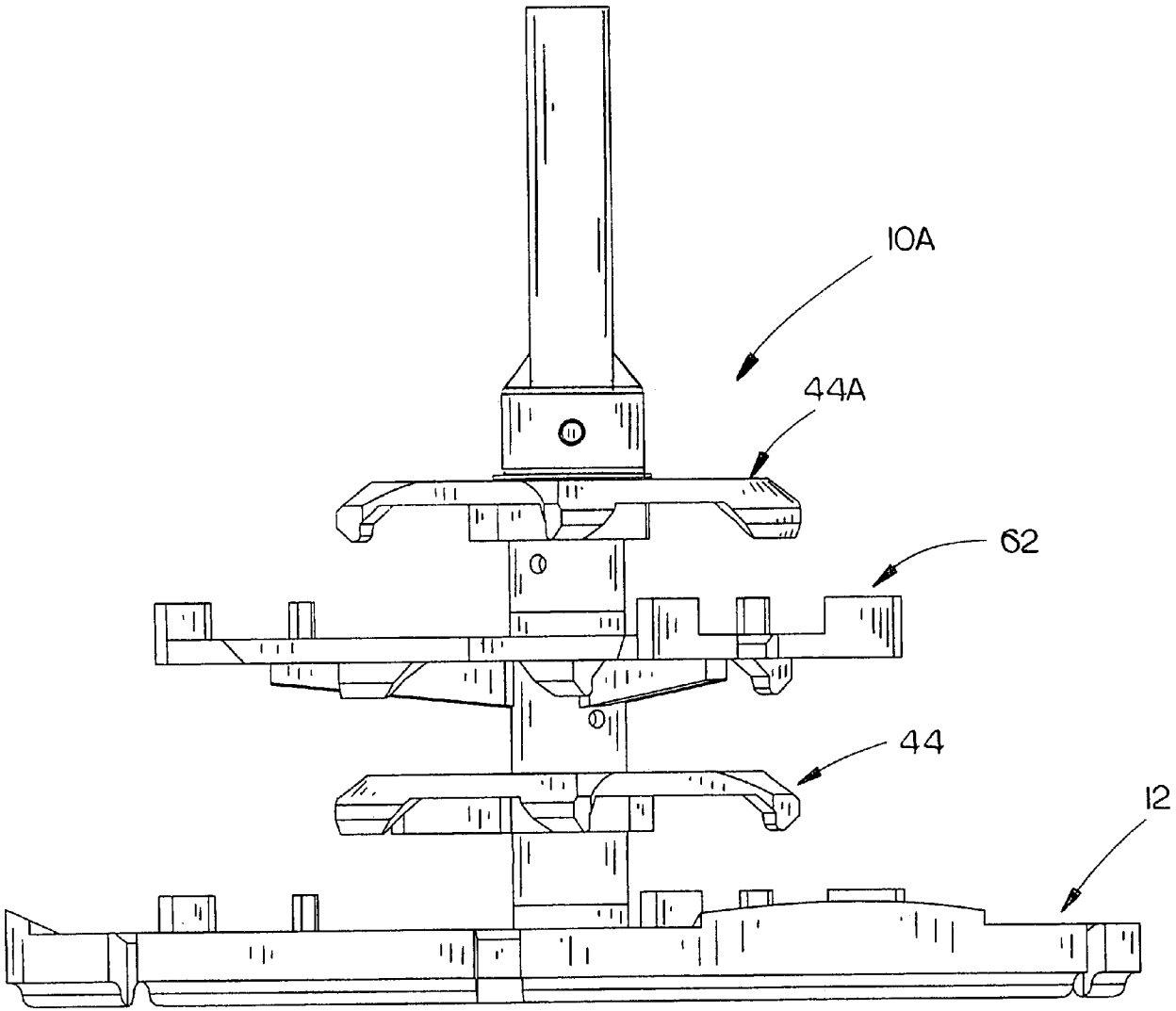
FIG. 28 is a side view of the embodiment of FIG. 27.

A modified version of the tray 10 is shown in FIGS. 27 and 28 and which is designated by the reference numeral 10A. Tray 10A is a shorter version of tray 10 and is comprised of a first member 12, a second member 44, a third member 62 and a fourth member 44A mounted on a support member similar to support member 40 except for the fact that it is shorter than support member 40.

Figure 29:
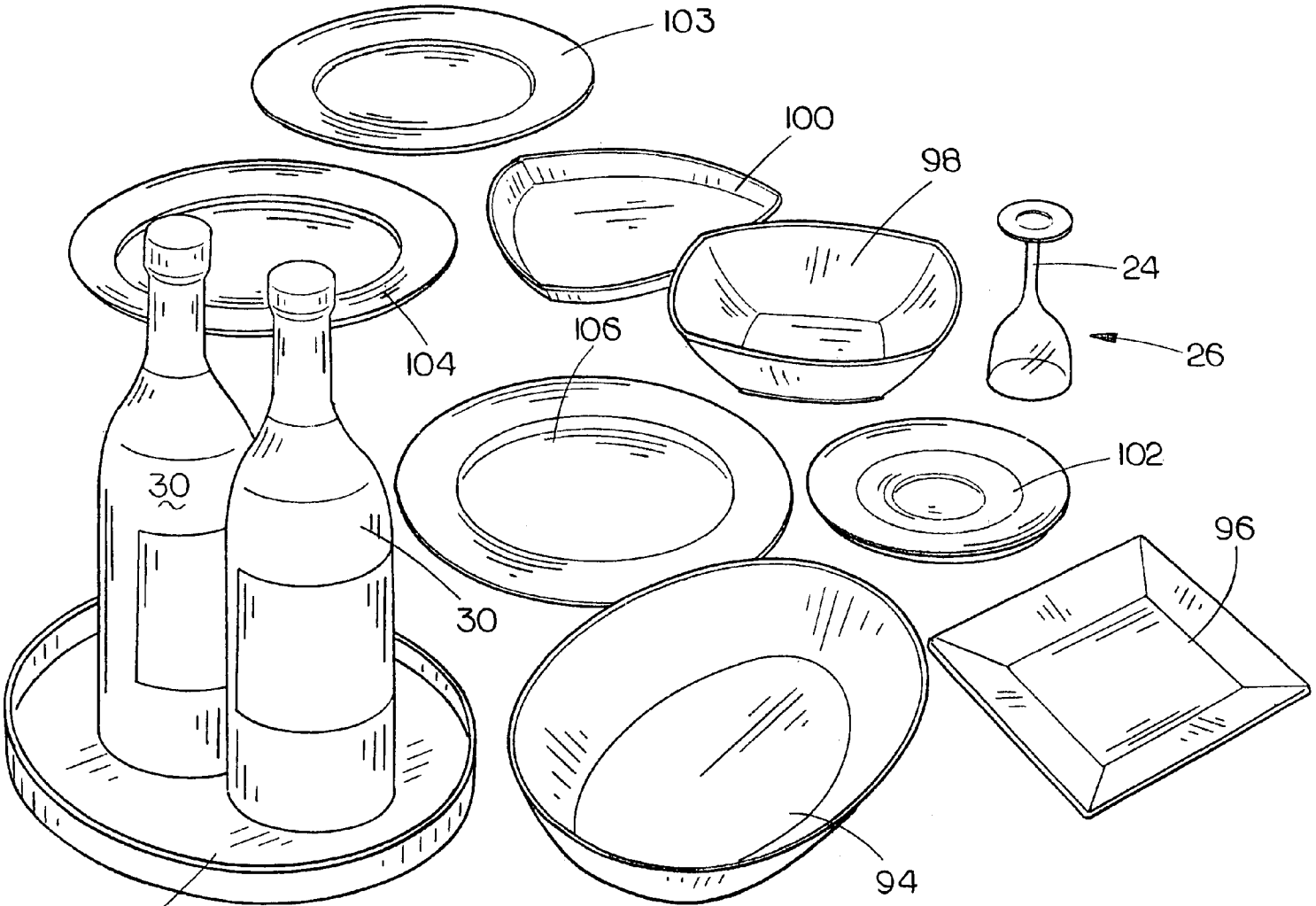
FIG. 29 is a perspective view illustrating the various sizes and types of dinnerware, glasses and wine bottles that may be carried by the tray of this invention.

For purposes of description, the numeral 94 refers to an oval bowl while the numerals 96, 98 and 100 refer to different types of bowls. In the drawings, the numeral 102 refers to a saucer while the numerals 103, 104 and 106 refer to different types of sizes of plates. In FIG. 29, the numeral 108 refers to a serving tray of conventional design.

Figure 8:
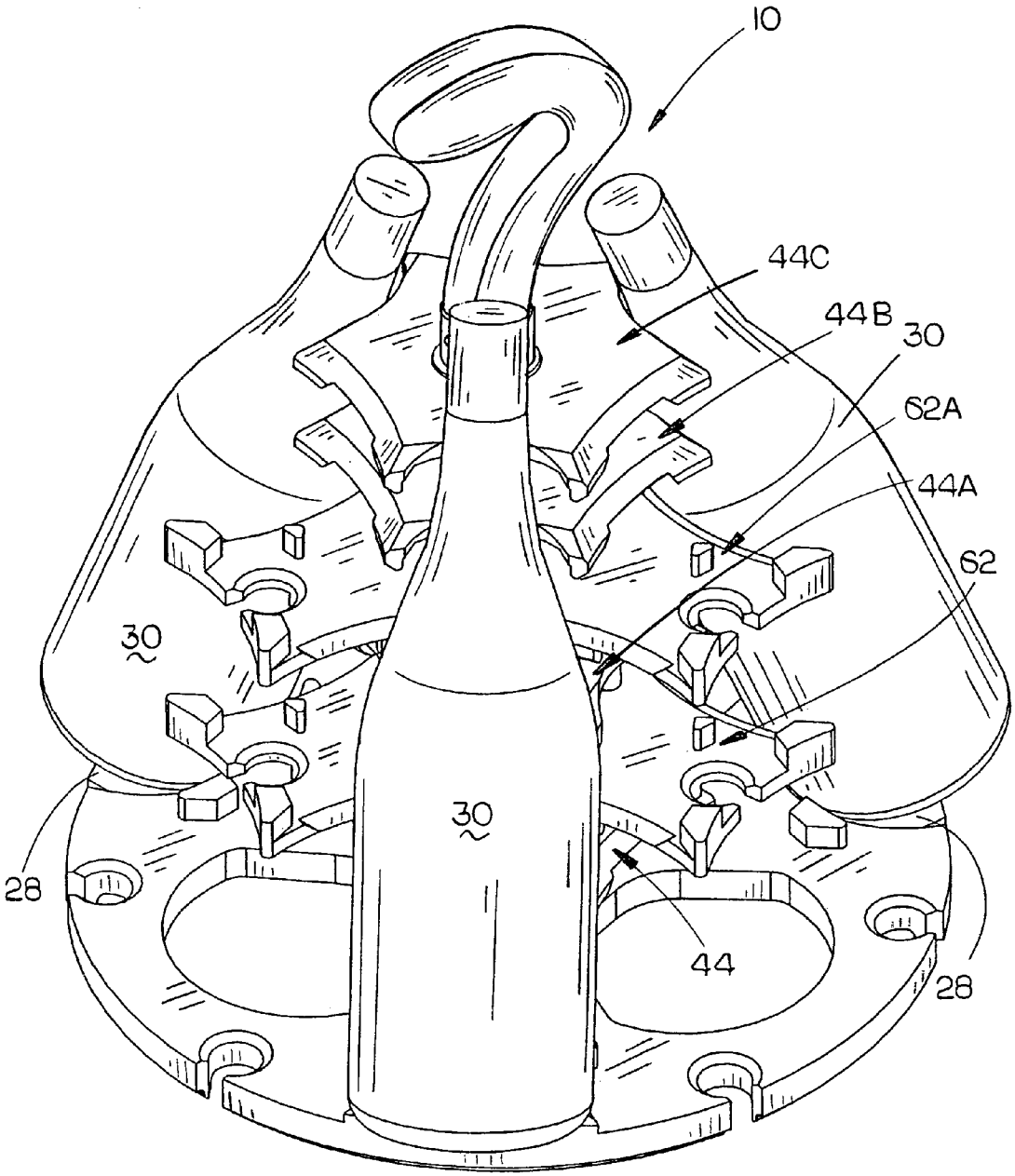
FIG. 8 is a perspective view illustrating the tray of FIG. 1 having three wine bottles mounted thereon.
Figure 9:
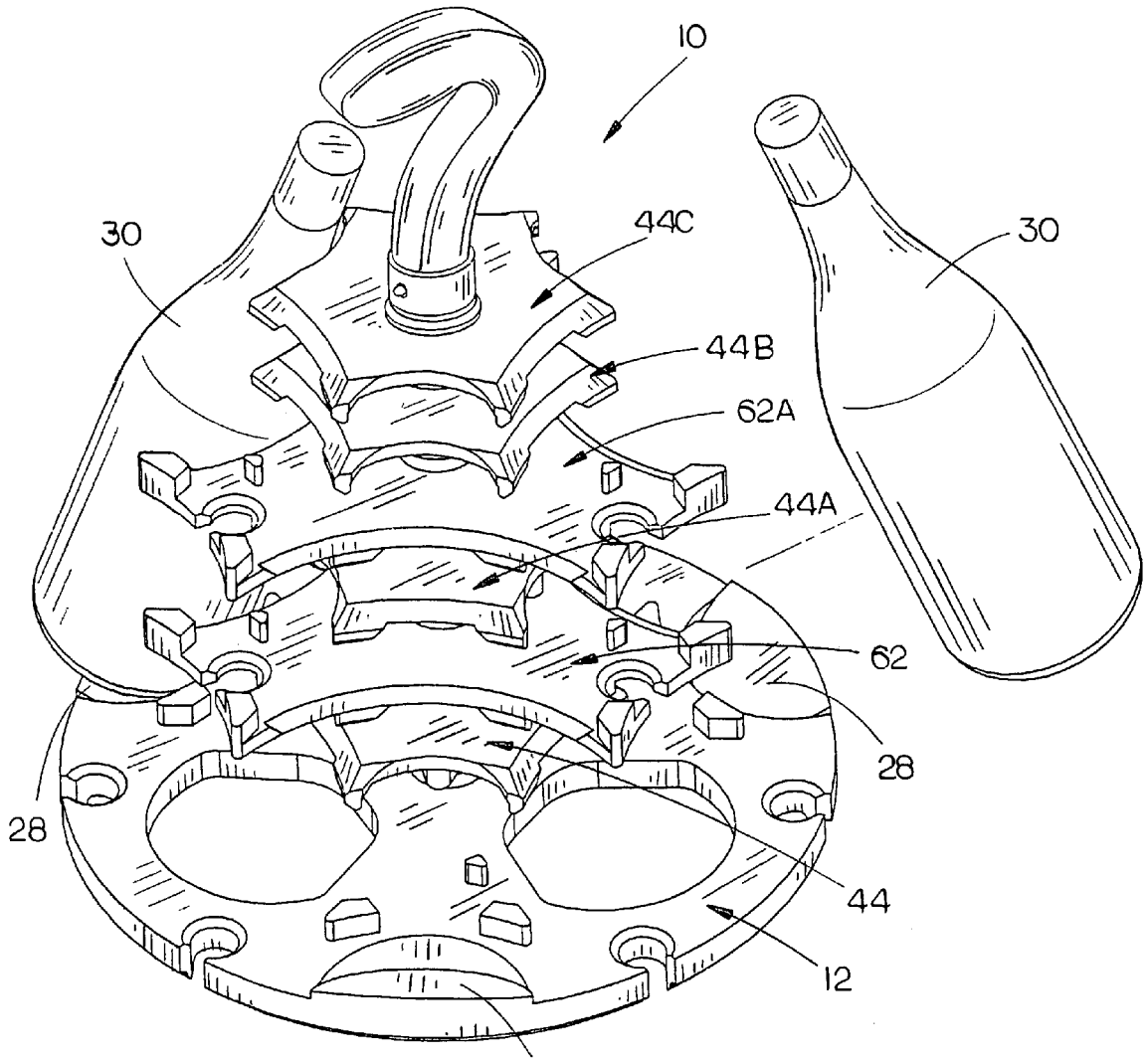
FIG. 9 is a perspective view illustrating the manner in which wine bottles may be positioned on the tray.
Figure 10:
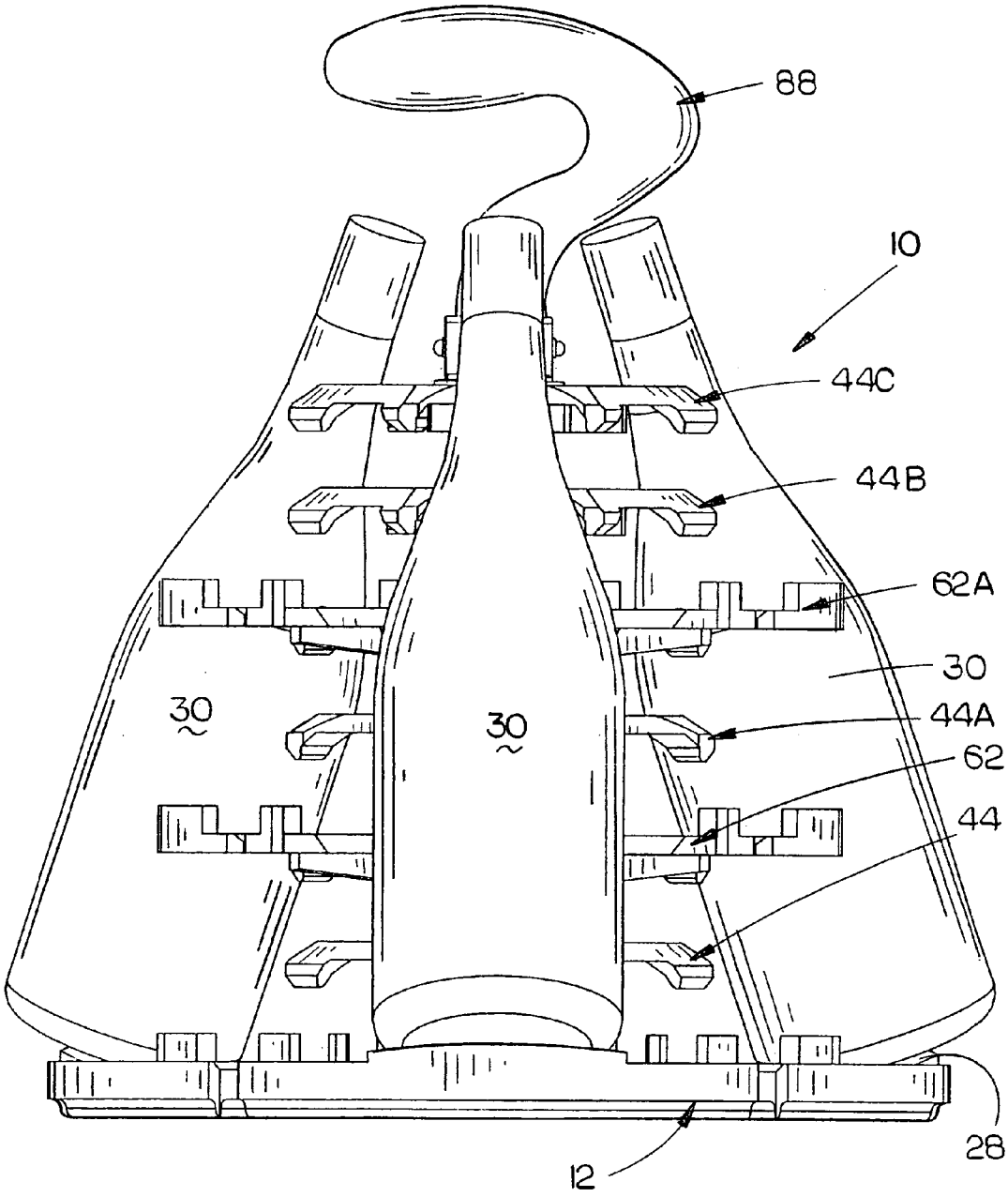
FIG. 10 is a side view illustrating the tray of this invention having three wine bottles positioned thereon.
Figure 13:
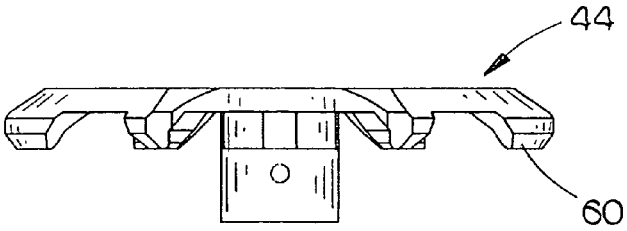
FIG. 13 is a side view of the second disc-shaped member of this invention.
Figure 12:
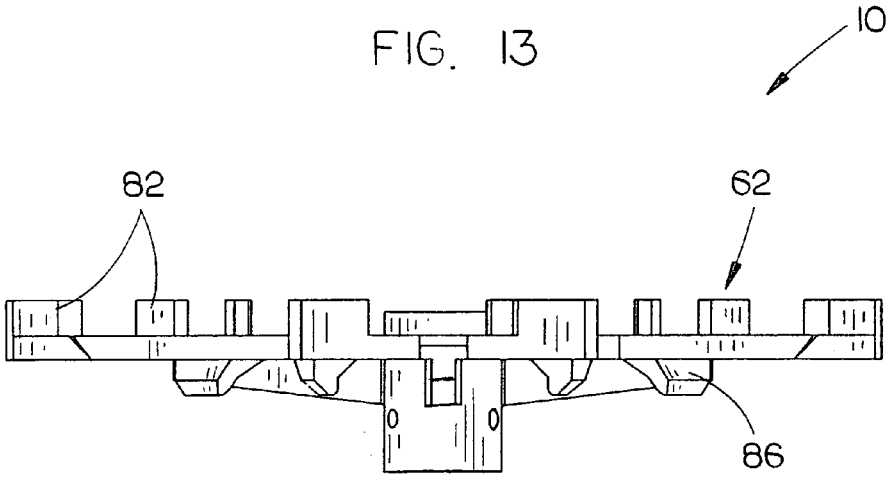
FIG. 12 is a side view of the third disc-shaped member of the tray of this invention.
Figure 11:
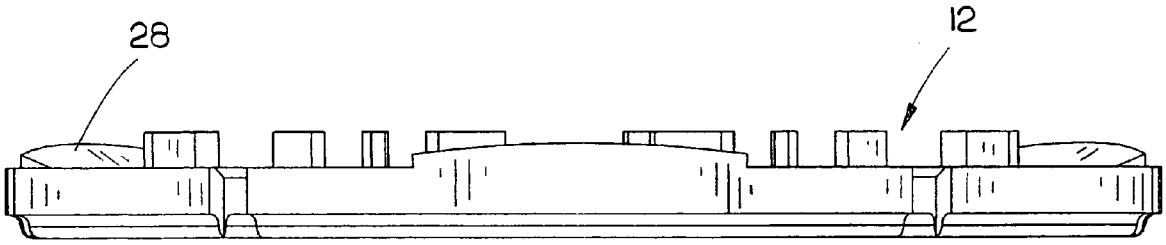
FIG. 11 is a side view of the first disc-shaped member of this invention.

When it is desired to use the tray 10 to carry wine bottles to a customer's table, the following steps are taken. First, the member 44 is rotated so that the cut-outs 56 are vertically aligned with the inclined surfaces 28. The same procedure is followed with respect to members 44A, 44B and 44C. The member 62 is rotated until the cut-outs 76 are aligned with the inclined surfaces 28. The same procedure is followed with respect to member 62A. The detent balls 42 will be received by the appropriate openings in the hubs of the members 44, 62, 44A, 62A, 44B and 44C to maintain those members in the proper position. Wine bottles 30 are then placed on the inclined surfaces 28 as seen in FIGS. 8 and 10.

If desired, wine glasses 26 may also be placed on the tray 10 by inserting the stems 24 of the glasses 26 with the openings 22 in member 12, and openings 80 in members 62 and/or 62A.

Figure 23:
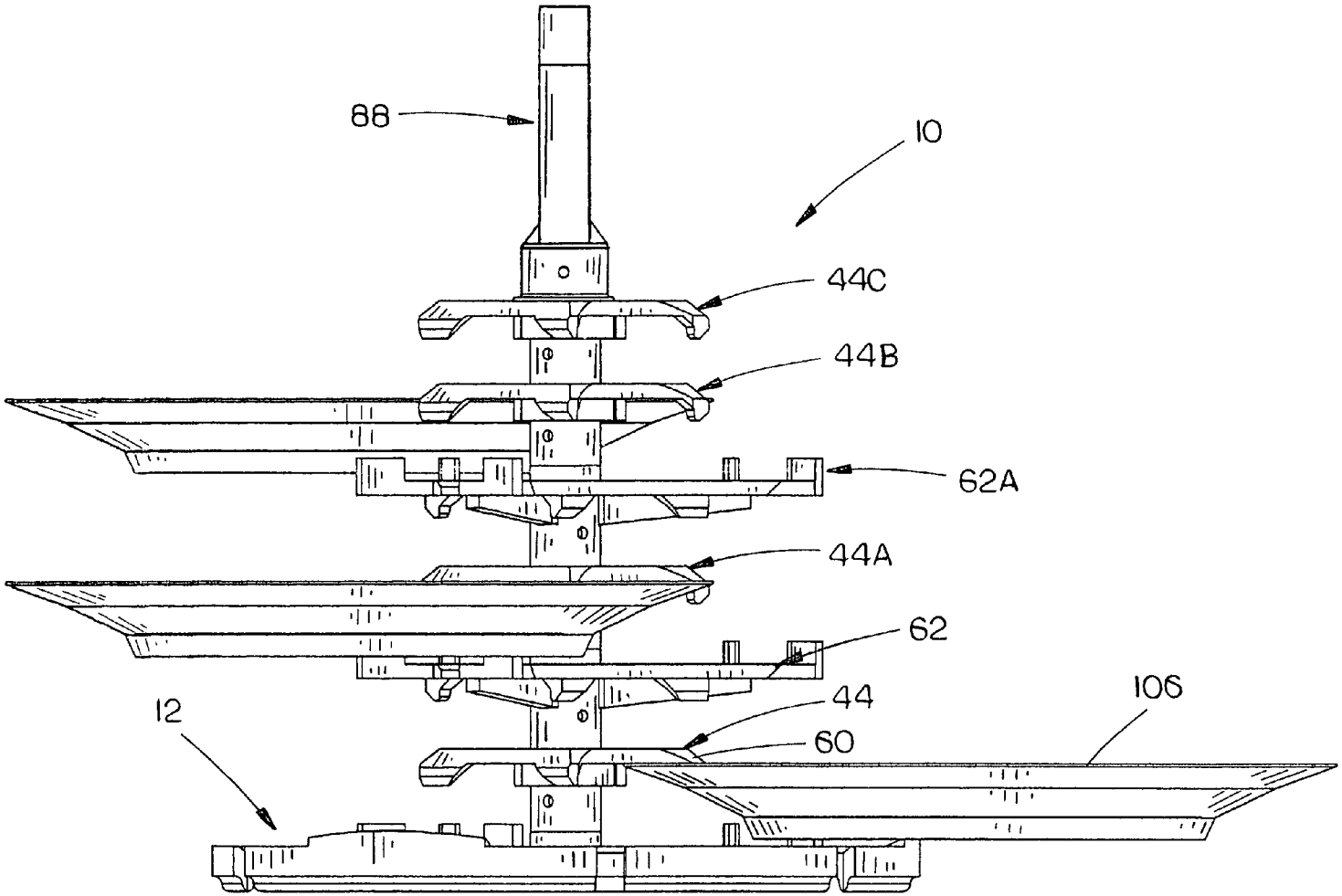
FIG. 23 is a side view of the preferred embodiment of this invention holding a plurality of plates thereon.
Figure 24:
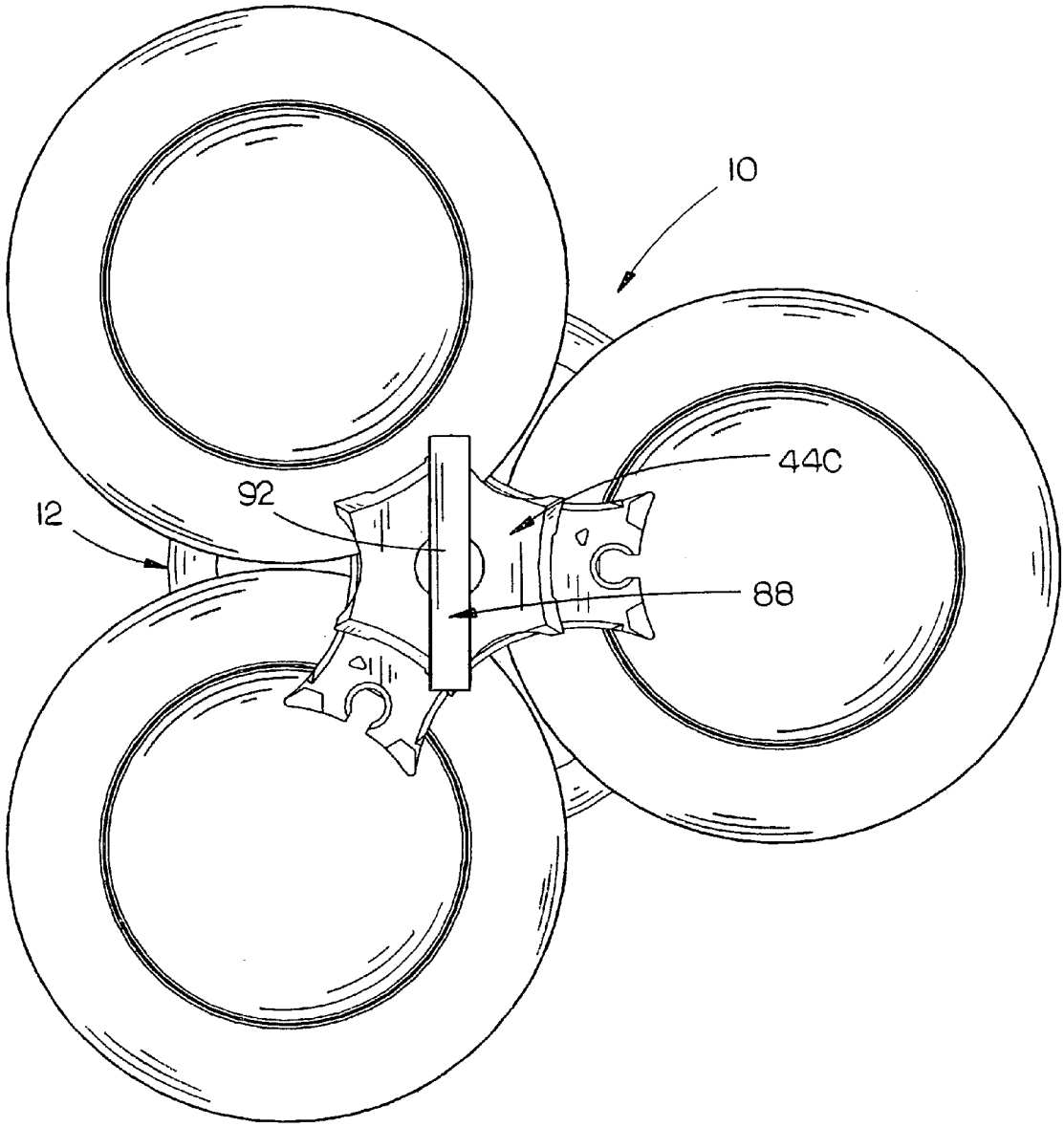
FIG. 24 is a top view of the preferred embodiment of this invention illustrating a plurality of plates being carried or supported thereon.
Figure 25:
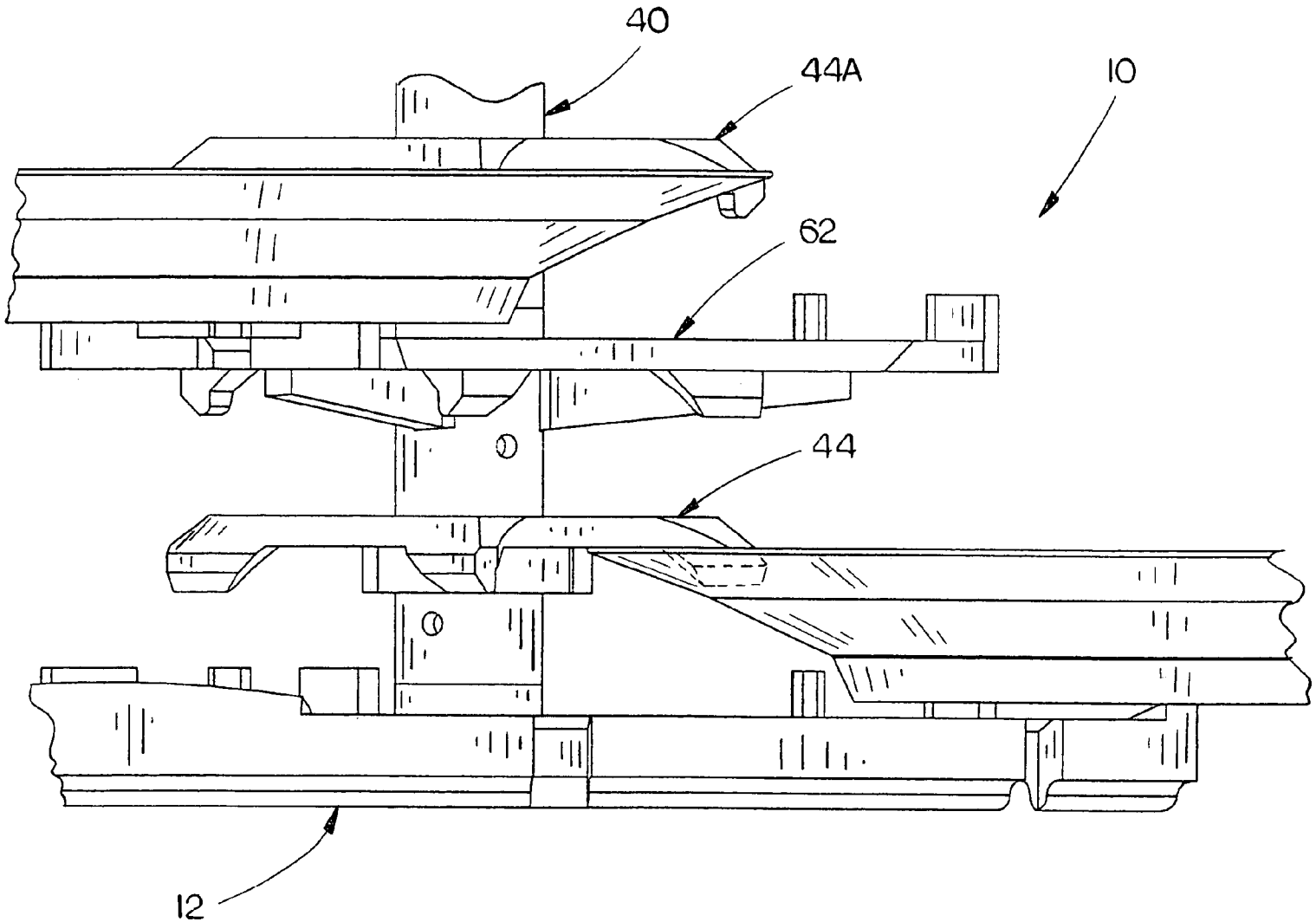
FIG. 25 is a partial side elevational view illustrating the manner in which plates are mounted on the preferred embodiment of this invention.
Figure 26:
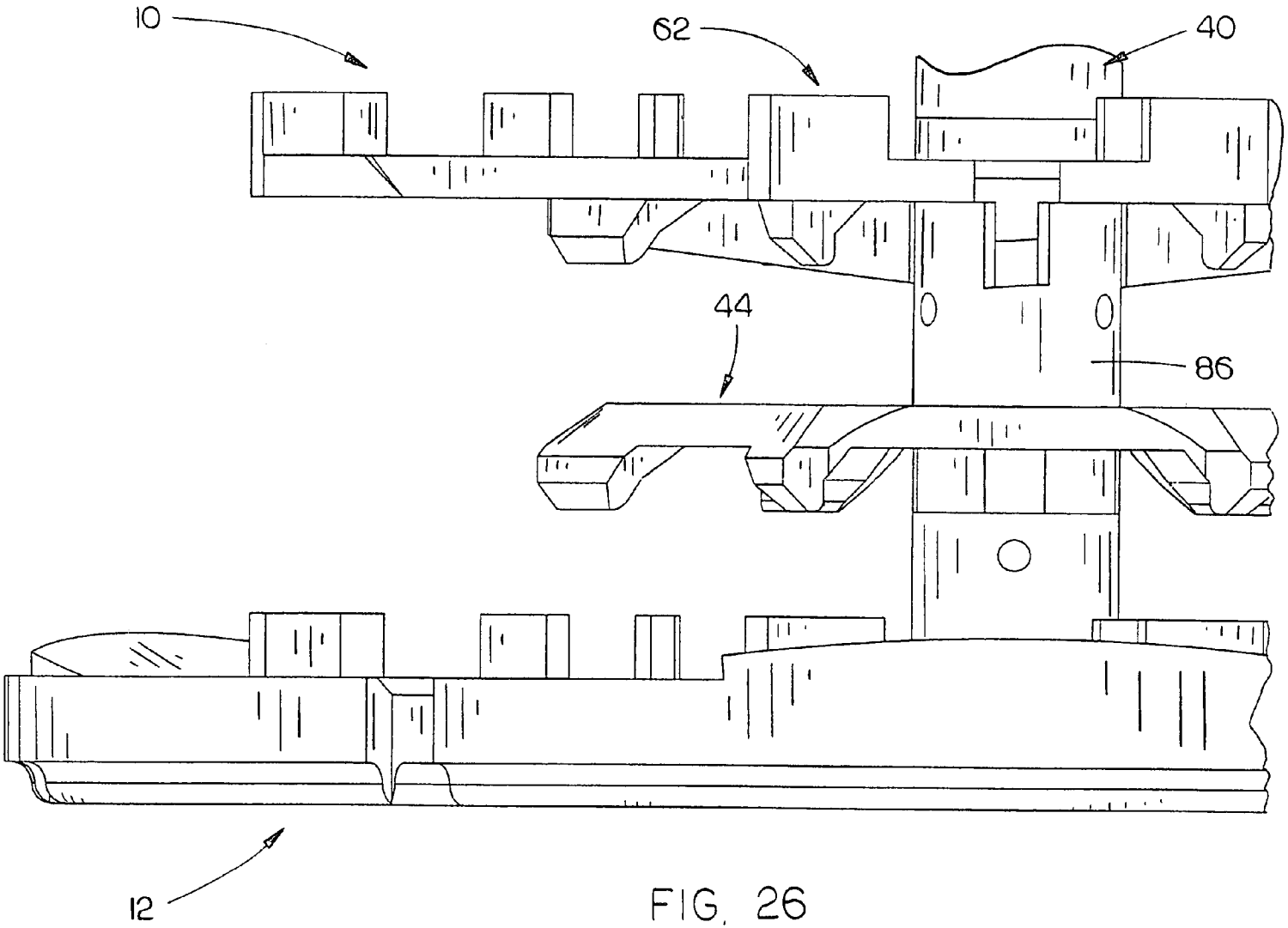
FIG. 26 is a partial side view of the lower portion of the preferred embodiment of this invention.

When it is desired to carry dinnerware having food thereon to the customers' table, the member 44 is rotated so that the projections 60 thereon are aligned with the projections 32, 34 on member 12. A plate 106 may then be inserted between members 12 and 44 as seen in FIG. 23. In the position of FIG. 23, the bottom of the plate 106 will rest on the projections 32 and 34 of member 12 and the projections 60 will be positioned inside the upper rim of the plate 106. The associated projection or stop 36 limits the inward movement of the plate 106 with respect to the tray 10. The weight of the plate 106 will prevent the plate 106 from disengaging from the tray 10 until the waiter removes the plate 106 from the tray 10 by slightly raising the outer end of the plate 106 and then moving the plate 106 outwardly from the tray 10. Additional plates 106 may also be placed on the tray 10 between members 62 and 44A and between members 62A and 44B as illustrated in FIG. 23.

Figure 2:
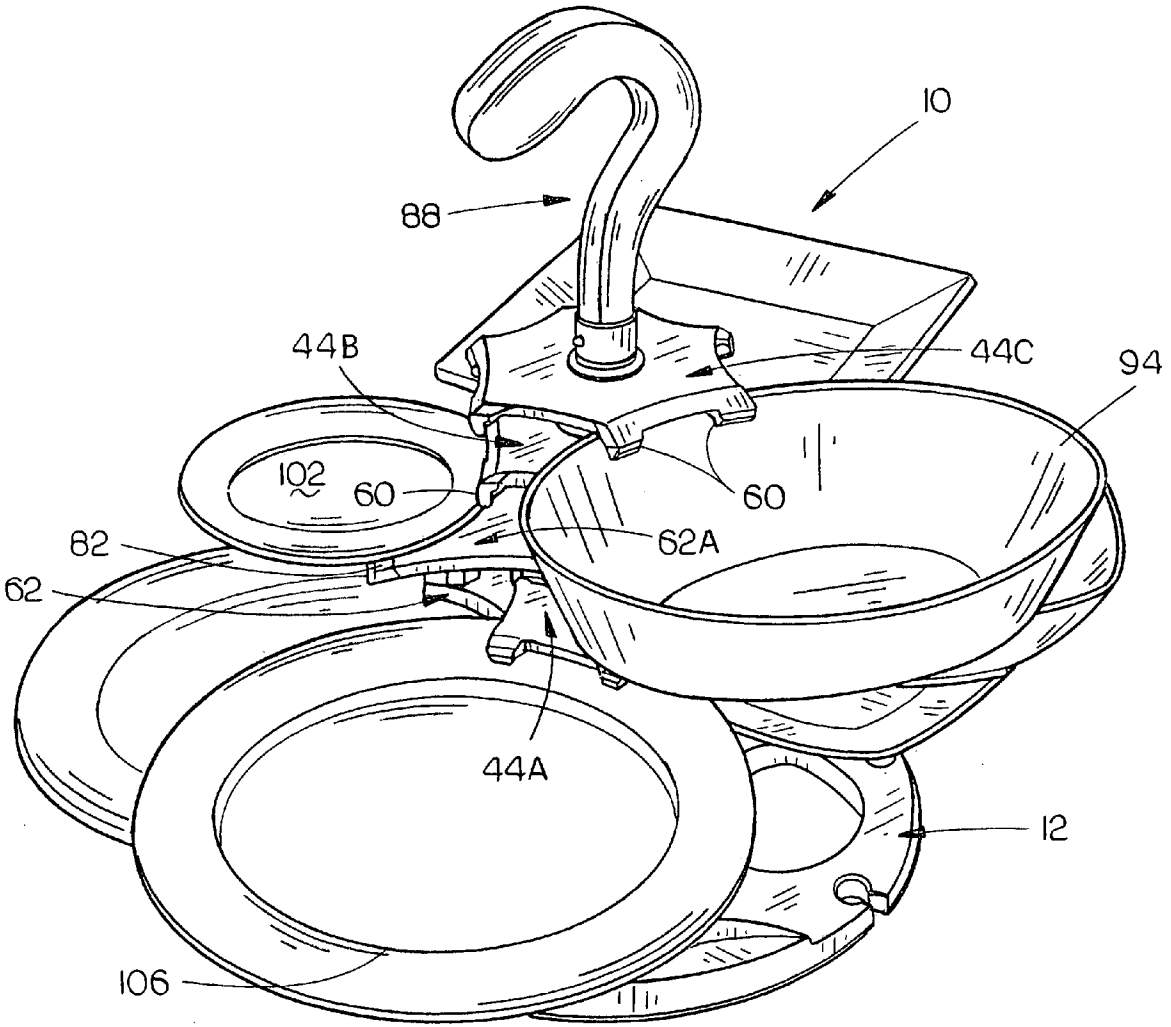
FIG. 2 is a perspective view illustrating the tray of FIG. 1 being used to carry various plates and bowls.
Figure 3:
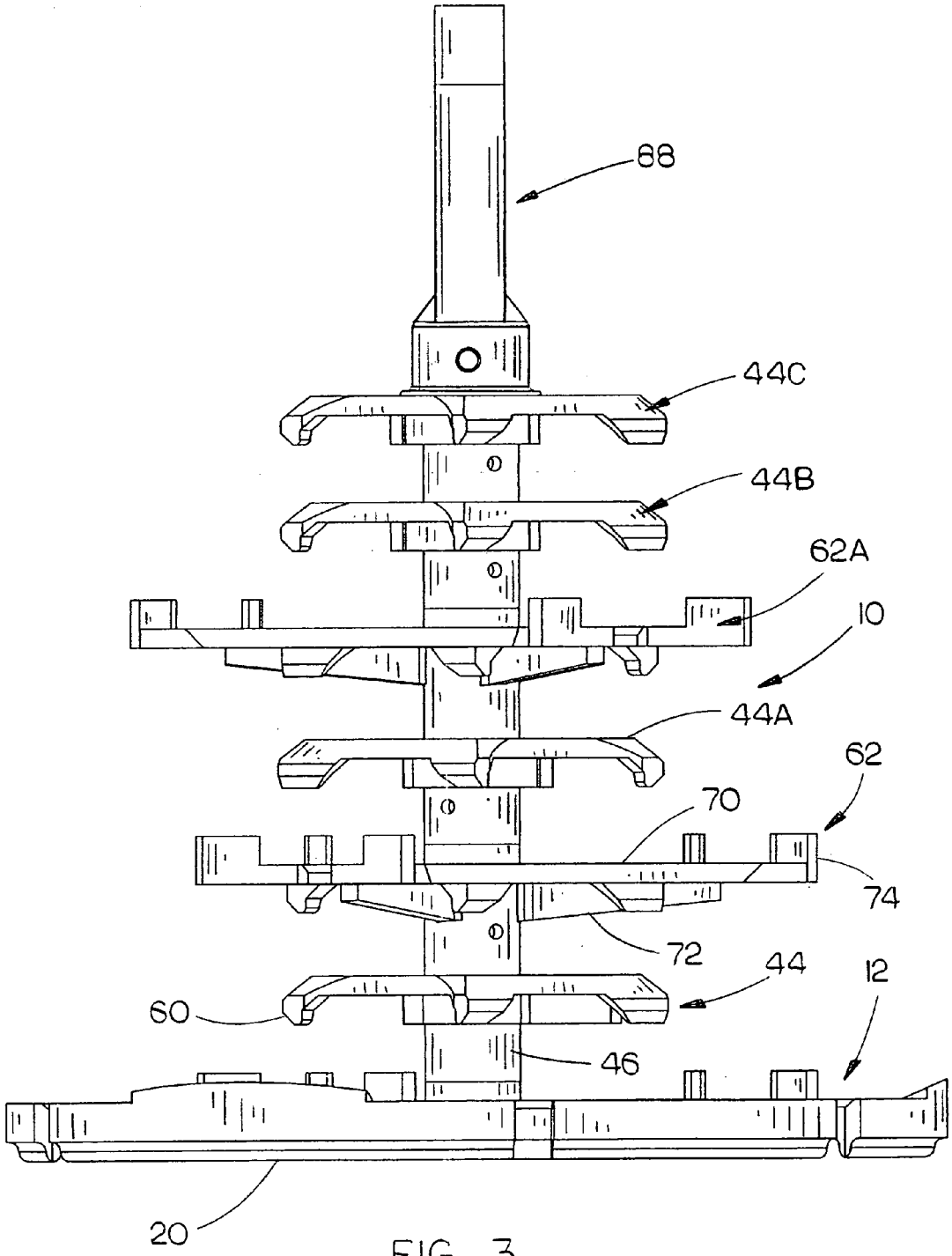
FIG. 3 is a side view of the tray of FIG. 1.
Figure 4:
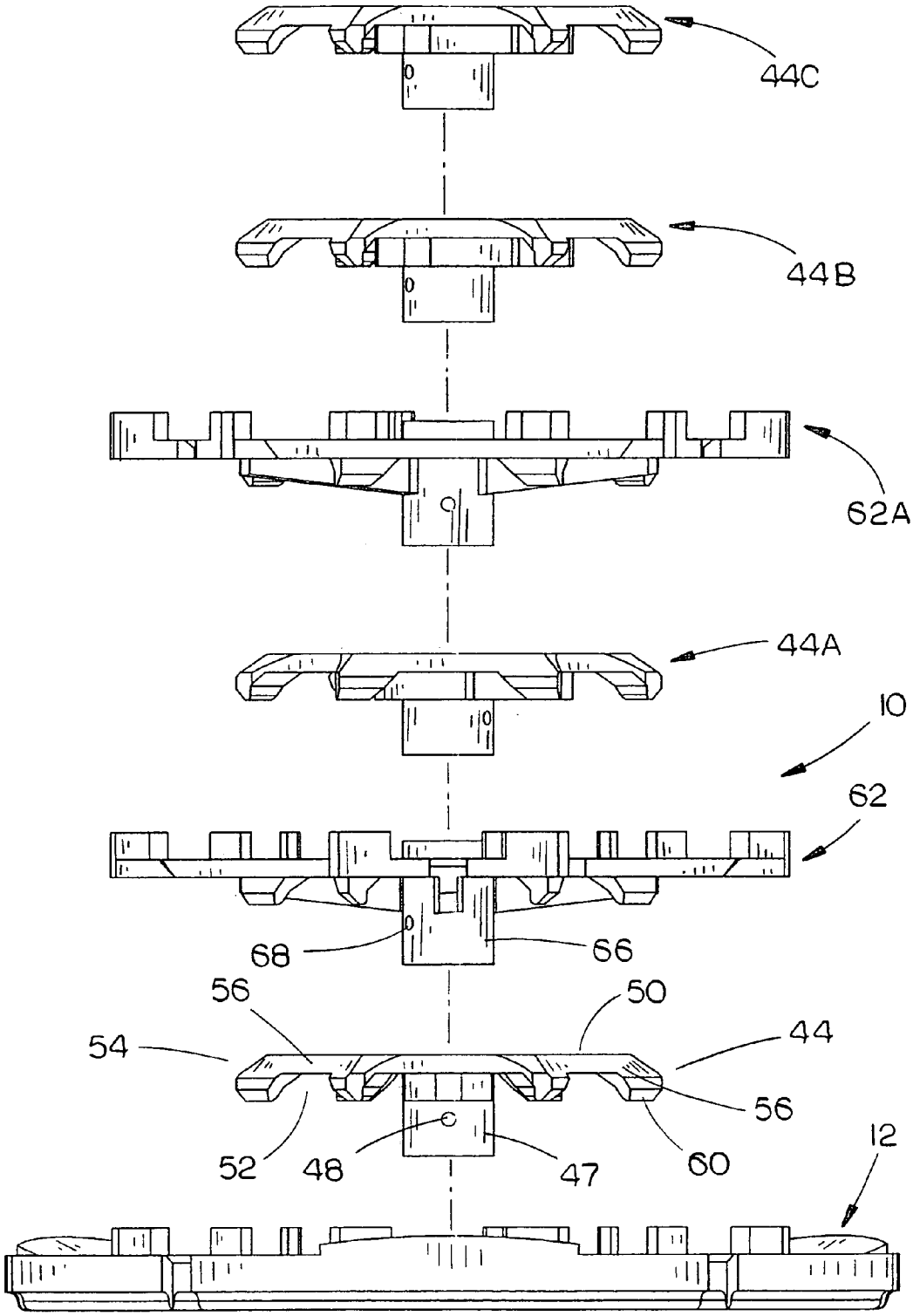
FIG. 4 is a partial exploded side view of the tray of FIG. 1.

The tray 10 will also permit a bowl 94 to be carried thereby as seen in FIG. 2. The member 44C is first rotated to the position of FIG. 2. The member 44B is then rotated with respect to member 44C so that the lobes of member 44B are radially offset with respect to the lobes of member 44C. Member 62A is then rotated so that the lobes thereof are directly below the lobes of member 44C. The bowl 94 may then be slightly tipped and inserted between the members 44C and 62A so that the bottom of the bowl 94 will rest on the projections 82 of member 62A with the projections 60 of member 44C being positioned inwardly of the upper rim of bowl 94 as seen in FIG. 2.

FIG. 2 also illustrates that the tray 10 may also be used to carry small saucers 102. First, member 44B is rotated so that the projections 60 face outwardly. The member 62A is rotated so that the lobes thereof with the projections 82 are facing outwardly. The saucer 102 may then be positioned between members 44B and 62A as seen in FIG. 2 so that the bottom of saucer 102 rests on the projections 82 of member 62A and so that the projections 60 of member 44B are in engagement with the saucer 102 slightly inwardly of the upper rim thereof.

It can therefore be seen that the tray 10 may be used to carry many plates of different sizes as well as carrying bowls of different sizes and shapes. The selective positioning of the members 44, 62, 44A, 62A, 44B and 44C provides great versatility to the tray. The tray 10A functions in the same manner as tray 10 except that it is shorter in height.

Figure 30:
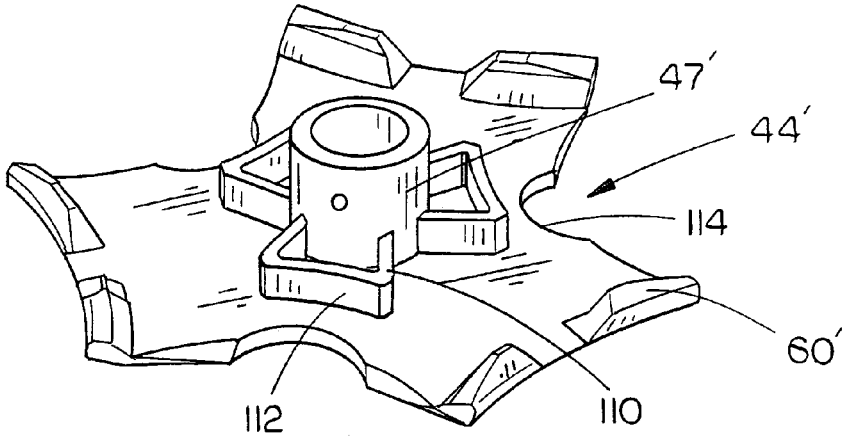
FIG. 30 is a bottom perspective view of a slightly modified second disc-shaped member.

FIG. 30 is a bottom perspective view of a slightly modified version of the disc-shaped member 44 which is identified by the reference numeral 44'. Hub 66' of member 44' has three generally U-shaped members secured thereto which extend outwardly therefrom and which include slightly concave outer ends 112. Member 44' also has three semi-circular recesses 114 extending into the periphery thereof. The shape of the projections 60' are also slightly different than the projections 60 in member 44.

Figure 31:
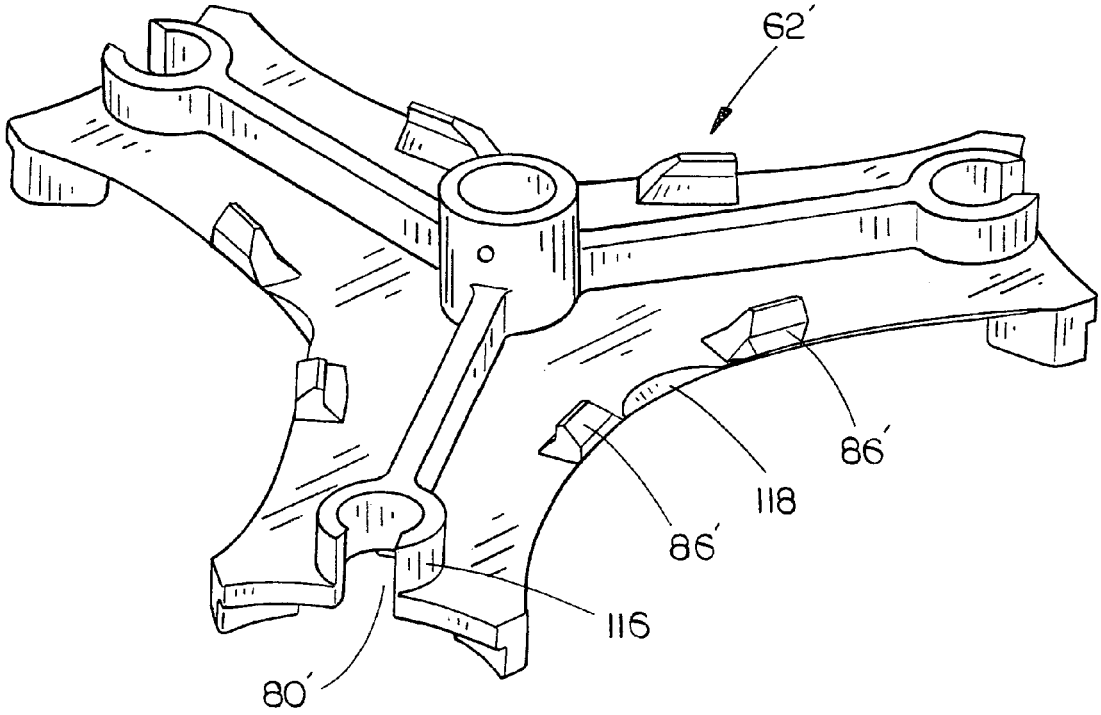
FIG. 31 is a bottom perspective view of a slightly modified third disc-shaped member.

FIG. 31 is a bottom perspective view of a slightly modified version of the disc-shaped member 62 which is identified by the reference numeral 62'. The primary difference between members 62 and 62' is that the underside of member 62' has supports 116 which communicate with the openings 80'. Another difference is that a generally semi-circular recess 118 is formed in the periphery of member 62' between each pair of projections 86'.

Figure 32:
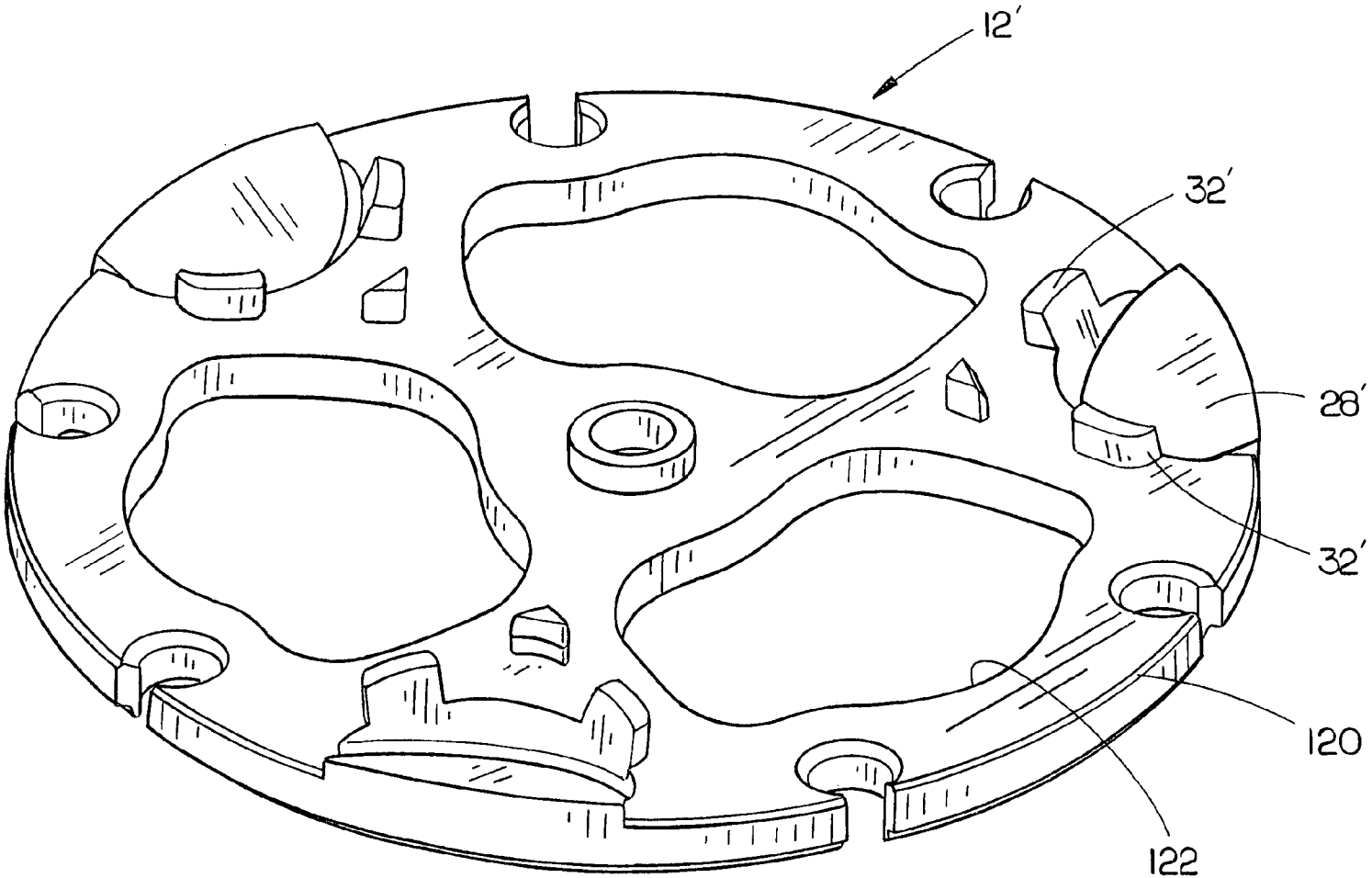
FIG. 32 is a top perspective view of a slightly modified first disc-shaped member.

FIG. 32 is a top perspective view of a slightly modified version of member 12 and which is referred to by the reference numeral 12'. As seen in FIG. 32, the member 12' has a beveled upper edge. The shape of the projections 32' is slightly different than the projections 32 of member 12 and are positioned adjacent the inner end of inclined surfaces 28'. The cut-outs 122 in member 12' are also larger than the cut-outs in member 12 to reduce the weight of the tray.

It can therefore be seen that an improved tray has been provided for carrying food and contained beverages as well as wine glasses. The invention described above permits food service providers at restaurants to carry multiple varying sizes and shapes of dinner, appetizer, and dessert plates and bowls thereon. The tray of this invention permits food service providers at restaurants to carry various sizes and shapes of dinnerware and beverage containers to the guests at tables efficiently. The tray of this invention accommodates the existing structure of various sizes and shapes of dinnerware to be carried to the guests in a restaurant in an efficient and safe manner whereby the food and contained beverages will be carried at close to floor level to minimize accidental spills on guests while seated. It can also be seen that the design of the tray of this invention permits the same to be carried at the side of a food service provider so that the food service provider has a clear view of his/her travel path while serving the guest or guests. It can also be seen that the tray of this invention is designed to minimize the food service provider's contact with potentially hot dinnerware. It can therefore be seen that the tray of this invention accomplishes at least all of its stated objectives.

Further, the tray 10 may be used as a dinnerware store display since the tray 10 may have several different plates and bowls positioned thereon for display purposes.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. A tray for displaying dinnerware or for carrying food and contained beverages, comprising:

an upstanding support member having upper and lower ends;

a first horizontally disposed and generally disc-shaped member secured at its center to said lower end of said upstanding support member;

said first disc-shaped member having a peripheral edge, an upper side and a lower side;

said first disc-shaped member having a plurality of radially-spaced apart pairs of horizontally spaced-apart projections which extend upwardly from said upper side thereof inwardly of said peripheral edge thereof;

a second horizontally disposed and generally disc-shaped second member secured at its center to said upstanding support member above said first disc-shaped member;

said second disc-shaped member having a peripheral edge, an upper side and a lower side;

said second disc-shaped member having a diameter less than said first disc-shaped member;

said second disc-shaped member having a plurality of radially spaced-apart cut-outs formed therein which define lobes therebetween having an arcuate outer end;

each of said lobes of said second disc-shaped member having a pair of horizontally spaced-apart projections extending downwardly from said lower side thereof at the outer end thereof;

a third horizontally disposed and generally disc-shaped member secured at its center to said upstanding support member above said second disc-shaped member;

said third disc-shaped member having a peripheral edge, an upper side and a lower side;

said third disc-shaped member having a diameter which is greater than the diameter of said second disc-shaped member and which is less than the diameter of said first disc-shaped member;

said third disc-shaped member having a plurality of radially spaced-apart cut-outs formed therein which define lobes therebetween having an arcuate outer end;

each of said lobes of said third disc-shaped member having a pair of horizontally spaced-apart projections extending upwardly from said upper side thereof at the outer end thereof;

a fourth horizontally disposed and generally disc-shaped member is secured at its center to said upstanding support member above said third disc-shaped member;

said fourth disc-shaped member having a peripheral edge, an upper side and a lower side;

said fourth disc-shaped member having a diameter which is less than the diameter of said third disc-shaped member;

said fourth disc-shaped member having a plurality of radially spaced-apart cut-outs formed therein which define lobes therebetween having an arcuate outer end;

each of said lobes of said fourth disc-shaped member having a pair of horizontally spaced-apart projections extending downwardly from said lower side thereof at the outer end thereof;

and a carrying handle secured to said upper end of said upstanding support member.

2. The tray of claim 1 wherein said handle includes a horizontally disposed portion which is centered over and above said upper end of said upstanding support member.

3. The tray of claim 1 wherein said first disc-shaped member has at least one opening extending into its peripheral edge between said pairs of projections, for receiving the stem of an upside-down wine glass therein.

4. The tray of claim 1 wherein said third disc-shaped member has at least one opening extending into teach of said lobes therefrom from its peripheral edge for receiving the stems of an upside-down wine glass therein.

5. The tray of claim 1 wherein said upper side of said first disc-shaped member has an inclined semi-circular recess formed therein outwardly of each of said pairs of projections thereof for partially receiving the bottom of an inclined wine bottle thereon to support the same.

6. The tray of claim 1 wherein said second, third and fourth disc-shaped members are selectively rotatably mounted on said upstanding support member.

7. The tray of claim 1 wherein said upper side of said first disc-shaped member has at least one upwardly extending stop which is positioned inwardly of each of said pairs of projections and wherein said upper side of said third disc-shaped member has at least one upwardly extending stop which is positioned inwardly of said projections on each of said lobes thereof.

8. The tray of claim 1 wherein a fifth horizontally disposed and generally disc-shaped member is secured at its center to said upstanding support member above said fourth disc-shaped member, said fifth disc-shaped member being substantially identical to said third disc-shaped member, and wherein a sixth horizontally disposed and generally disc-shaped member is secured at its center to said upstanding support member above said fifth disc-shaped member, said sixth disc-shaped member being substantially identical to said fourth disc-shaped member and to said second disc-shaped member.

9. The tray of claim 8 wherein said fifth and sixth disc-shaped members are selectively rotatably secured to said upstanding support member.

10. The tray of claim 8 wherein a seventh horizontally disposed and generally disc-shaped member is secured at its center to said upstanding support member above said sixth disc-shaped member, said seventh disc-shaped member being substantially identical to said sixth disc-shaped member.

11. The tray of claim 10 wherein said seventh disc-shaped member is selectively rotatably secured to said upstanding support member.

12. The tray of claim 1 wherein said disc-shaped member and said upstanding support member are comprised of a plastic material.

13. The tray of claim 1 wherein each of said second, third and fourth disc-members are held in selective positions of rotation with respect to said upstanding support member by a detent means.

14. The tray of claim 11 wherein each of said second, third, fourth, fifth, sixth and seventh disc-shaped members are held in selective positions of rotation with respect to said upstanding support member by a detent.

* * * * *